US009500975B2

(12) United States Patent
Sugahara et al.

(10) Patent No.: US 9,500,975 B2
(45) Date of Patent: Nov. 22, 2016

(54) MAGNETIC CARRIER AND TWO-COMPONENT DEVELOPER

(71) Applicant: CANON KABUSHIKI KAISHA, Tokyo (JP)

(72) Inventors: Nobuyoshi Sugahara, Tokyo (JP); Hironori Minagawa, Moriya (JP); Yuto Onozaki, Shimotsuma (JP); Minoru Yoshifuku, Iga (JP); Wakashi Iida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/631,805

(22) Filed: Feb. 25, 2015

(65) Prior Publication Data

US 2015/0241807 A1 Aug. 27, 2015

(30) Foreign Application Priority Data

Feb. 27, 2014 (JP) ..... 2014-036232
Feb. 20, 2015 (JP) ..... 2015-032148

(51) Int. Cl.
*G03G 9/08* (2006.01)
*G03G 9/107* (2006.01)
*G03G 9/113* (2006.01)

(52) U.S. Cl.
CPC ..... *G03G 9/1075* (2013.01); *G03G 9/113* (2013.01); *G03G 9/1133* (2013.01)

(58) Field of Classification Search
CPC ... G03G 9/1075; G03G 9/113; G03G 9/1133
USPC ..... 430/111.32, 111.35
See application file for complete search history.

(56) References Cited

U.S. PATENT DOCUMENTS 5,629,119 A * 5/1997 Inoue ..... G03G 9/10 430/111.3
5,912,099 A 6/1999 Kanbayashi et al.
6,372,400 B1 4/2002 Yoshizaki et al.
7,279,262 B2 10/2007 Fujikawa et al.
2015/0017581 A1 1/2015 Tsuchida et al.

FOREIGN PATENT DOCUMENTS

EP 0 974 873 A2 1/2000
EP 1 065 571 A2 1/2001

(Continued)

OTHER PUBLICATIONS

U.S. Appl. No. 14/691,514, filed Apr. 20, 2015. Inventor: Daisuke Tsujimoto, et al.

(Continued)

*Primary Examiner* — Mark A Chapman
(74) *Attorney, Agent, or Firm* — Fitzpatrick, Cella, Harper & Scinto

(57) ABSTRACT

Provided is a magnetic carrier, including magnetic carrier particles each including: a magnetic carrier core including a magnetic material and a resin; and a resin coating layer formed on a surface of the magnetic carrier core, in which: the resin included in the magnetic carrier core has a hydroxy group; a surface portion of the magnetic carrier core includes a specific compound; and the magnetic carrier has an adsorbed moisture amount of 0.40 mass % or less when the magnetic carrier is left to stand in an environment of a temperature of 30° C. and a humidity of 80% RH for 72 hours.

11 Claims, 3 Drawing Sheets

(56) References Cited

FOREIGN PATENT DOCUMENTS

| | | | |
|---|---|---|---|
| EP | 1 237 051 | A2 | 9/2002 |
| EP | 2 416 220 | A1 | 2/2012 |
| JP | 62-121463 | A | 6/1987 |
| JP | 4-198946 | A | 7/1992 |
| JP | 7-104522 | A | 4/1995 |
| JP | 9-127736 | A | 5/1997 |
| JP | 2001-75315 | A | 3/2001 |
| JP | 2009-139707 | A | 6/2009 |

OTHER PUBLICATIONS

European Search Report dated Jun. 29, 2015 in European Application No. 15156671.8.

* cited by examiner

MAGNETIC CARRIER AND TWO-COMPONENT DEVELOPER

BACKGROUND OF THE INVENTION

Field of the Invention

The present invention relates to a magnetic carrier to be used in a two-component developer for developing (visualizing) an electrostatic latent image (electrostatic charge image) by electrophotography, and to a two-component developer containing the magnetic carrier.

Description of the Related Art

In recent years, electrophotography has widely been employed in a copying machine, a printer, or the like. The electrophotography is required to be able to correspond to various targets such as a thin line, a small character, a photograph, and a full-color image. In addition, the electrophotography is required to be able to correspond to a high-quality image and a high-speed and continuous image output. Those demands are considered to increasingly grow in the future.

In order to satisfy those demands, light-weight composite particles each having a specific gravity of approximately 2.0 or more and 4.5 or less are often used as magnetic carrier particles in a magnetic carrier to be used in a two-component developer, because such composite particles are less liable to destroy toner particles even when an image is output at a higher speed and more continuously.

In addition, in order to output a high-quality image for a long period of time, it is important for the magnetic carrier to have such characteristics that an amount of charge to be imparted to toner hardly changes even when the magnetic carrier is used for a long period of time, and that an amount of charge to be imparted to toner hardly changes even when the magnetic carrier is subjected to an environmental change. In order to satisfy such characteristics, the magnetic carrier is required to have excellent durability.

As a technology for improving durability of the magnetic carrier, Japanese Patent Application Laid-Open No. H07-104522 discloses magnetic carrier particles obtained by forming a silicone resin coating layer containing a silane coupling agent or the like on surfaces of magnetic core particles (magnetic carrier core).

Japanese Patent Application Laid-Open No. S62-121463 discloses magnetic carrier particles obtained by treating surfaces of magnetic core particles (magnetic carrier core) with a coupling agent, and coating the surfaces with a silicone resin.

Japanese Patent Application Laid-Open No. H04-198946 discloses magnetic carrier particles obtained by treating surfaces of magnetic core particles (magnetic carrier core) with an aminosilane coupling agent, and forming on the surfaces a coating layer formed of a resin having a functional group capable of reacting with the aminosilane coupling agent.

In addition, from the viewpoint of weight saving of the magnetic carrier particles, magnetic carrier cores serving as constituents of the carrier particles each often have a configuration including a magnetic material and a resin (resin component).

A problem caused by using a resin in the magnetic carrier core is that an output image density and a color tint change through an environmental change from a low-humidity environment to a high-humidity environment. This seems to be attributed to moisture adsorbability of the resin.

Japanese Patent Application Laid-Open No. 2001-075315, Japanese Patent Application Laid-Open No. H09-127736, and Japanese Patent Application Laid-Open No. 2009-139707 each disclose a technology for specifying an adsorbed moisture amount of the magnetic carrier particles and suppressing the adsorbed moisture amount of the magnetic carrier particles.

However, the technologies disclosed as the technology for improving durability of the magnetic carrier in Japanese Patent Application Laid-Open No. H07-104522, Japanese Patent Application Laid-Open No. S62-121463, and Japanese Patent Application Laid-Open No. H04-198946 leave room for further improvement. In addition, the technologies disclosed as the technology for solving the problem caused by an environmental change from a high-humidity environment to a low-humidity environment in Japanese Patent Application Laid-Open No. 2001-075315, Japanese Patent Application Laid-Open No. H09-127736, and Japanese Patent Application Laid-Open No. 2009-139707 leave room for further improvement.

SUMMARY OF THE INVENTION

In view of the foregoing, the present invention is directed to providing a magnetic carrier containing magnetic carrier particles, which causes less changes in output image density and color tint even when subjected to an environmental change from a high-humidity environment to a low-humidity environment or from a low-humidity environment to a high-humidity environment, and has a light weight and high durability.

Further, the present invention is directed to providing a two-component developer containing the magnetic carrier.

According to one aspect of the present invention, there is provided a magnetic carrier, including magnetic carrier particles each including: a magnetic carrier core including a magnetic material and a resin; and a resin coating layer formed on a surface of the magnetic carrier core, in which: the resin included in the magnetic carrier core has a hydroxy group; a surface portion of the magnetic carrier core includes a compound represented by the following formula (1):

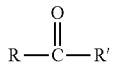

(1)

in the formula (1), R represents a hydrocarbon group having 8 or more carbon atoms, and R' represents —OH, —Cl, or —$OR^{10}$ and $R^{10}$ represents an organic group having 1 or more carbon atoms; and the magnetic carrier has an adsorbed moisture amount of 0.40 mass % or less when the magnetic carrier is left to stand in an environment of a temperature of 30° C. and a humidity of 80% RH for 72 hours.

According to another aspect of the present invention, there is provided a two-component developer containing the magnetic carrier and a toner.

According to one aspect of the present invention, it is possible to provide the magnetic carrier containing magnetic carrier particles, which causes less changes in output image density and color tint even when subjected to an environmental change from a high-humidity environment to a low-humidity environment or from a low-humidity environment to a high-humidity environment, and has a light weight and high durability.

According to another aspect of the present invention, it is possible to provide the two-component developer containing the magnetic carrier.

Further features of the present invention will become apparent from the following description of exemplary embodiments with reference to the attached drawings.

DESCRIPTION OF THE EMBODIMENTS

Figure 1:
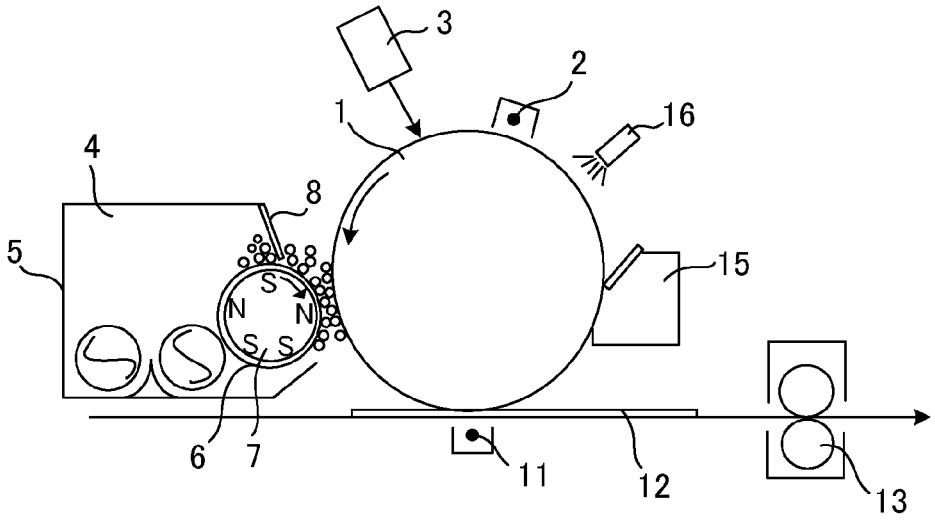
FIG. 1 is a schematic view of an image forming apparatus used in the present invention.

Preferred embodiments of the present invention will now be described in detail in accordance with the accompanying drawings.

Magnetic carrier particles included in a magnetic carrier of the present invention each include: a magnetic carrier core including a magnetic material and a resin (resin component); and a resin coating layer formed on a surface of the magnetic carrier core. In addition, the resin included in the magnetic carrier core has a hydroxy group, and a surface portion of the magnetic carrier core includes a compound represented by the following formula (1).

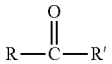

(1)

(In the formula (1), R represents a hydrocarbon group having 8 or more carbon atoms, and R' represents —OH, —Cl, or —$OR^{10}$ and $R^{10}$ represents an organic group having 1 or more carbon atoms.)

In addition, the magnetic carrier of the present invention has an adsorbed moisture amount of 0.40 mass % or less when the magnetic carrier is left to stand in an environment of a temperature of 30° C. and a humidity of 80% RH for 72 hours.

In recent years, magnetic carrier cores to be used in magnetic carrier particles each have been generally formed of a resin and a magnetic material, because the magnetic carrier particles have been required to have a light weight. Magnetic ferrite particles, which have hitherto widely been used as the magnetic carrier particles, can be produced at low cost, while the particles are heavy particles each having a specific gravity of 4.7 or more. Therefore, the resin to be used in the magnetic carrier core formed of the resin and the magnetic material is also required to be inexpensive.

An example of such resin is a phenol resin. The phenol resin is an excellent resin because of its cost and easy handleability, and in addition, because the phenol resin, which is a thermosetting resin, exhibits high strength after being formed into particles.

However, the phenol resin has high moisture adsorbability owing to the presence of a hydroxy group, and hence involves a problem in that an output image density and a color tint are liable to change through an environmental change.

In order to suppress such changes in output image density and color tint through an environmental change, the hydroxy group of the phenol resin has hitherto been allowed to react with a silane coupling agent. With this, the moisture adsorbability is reduced, and thus moisture adsorption can be suppressed in a high-humidity environment.

However, when the environmental changes from a high-humidity environment to a low-humidity environment, charge-up of toner is liable to occur. Therefore, there is still room for improvement in the changes in output image density and color tint through an environmental change.

As a result of diligent studies, the inventors of the present invention have found that a magnetic carrier that hardly causes the charge-up of toner even when subjected to an environmental change from a high-humidity environment to a low-humidity environment can be obtained by incorporating the compound represented by the formula (1) into the surface portion of the magnetic carrier core.

When the compound represented by the formula (1) is incorporated into the surface portion of the magnetic carrier core, the moisture adsorbability can be reduced, and the charge-up of toner can be suppressed.

Examples of the compound represented by the formula (1) include: a fatty acid having 9 or more carbon atoms without a hydroxy group; an ester compound of a fatty acid having 9 or more carbon atoms without a hydroxy group; an anhydride of a fatty acid having 9 or more carbon atoms without a hydroxy group; and a chloride of a fatty acid having 9 or more carbon atoms without a hydroxy group. Those compounds are highly hydrophobic, and tend to moderately charge toner.

The compound represented by the formula (1) may be incorporated into the surface portion of the magnetic carrier core in an unreacted state or in a state in which part of the hydroxy group of the resin in the magnetic carrier core is esterified with part of the compound represented by the formula (1). The latter case is preferred. When part of the hydroxy group of the resin in the magnetic carrier core is esterified with part of the compound represented by the formula (1), the number of hydroxy groups on the surface of the magnetic carrier core can be reduced. Therefore, the moisture adsorbability of the resin in the magnetic carrier core can be more reduced. In addition, it is possible to provide the magnetic carrier that is less affected by an environmental change for a longer period of time, because the compound represented by the formula (1) is added to the magnetic carrier core.

The esterification of part of the hydroxy group of the resin included in the magnetic carrier core with part of the compound represented by the formula (1) may be performed through a known reaction.

As a method of incorporating the compound represented by the formula (1) into the surface portion of the magnetic carrier core, there is given, for example, a method involving stirring while heating the magnetic carrier core and the compound represented by the formula (1), or a method involving using a mechanical shear force, or the like.

The magnetic carrier of the present invention has an adsorbed moisture amount of 0.40 mass % or less when the magnetic carrier is left to stand in an environment of a temperature of 30° C. and a humidity of 80% RH for 72 hours. With this, stability to a high-humidity environment is increased.

In the present invention, the compound represented by the formula (1) is incorporated into the surface portion of the magnetic carrier core in order that the magnetic carrier may have an adsorbed moisture amount of 0.40 mass % or less when the magnetic carrier is left to stand in an environment of a temperature of 30° C. and a humidity of 80% RH for 72 hours. The content of the compound represented by the formula (1) is preferably 0.3 part by mass or more and 4.0 parts by mass or less with respect to 100 parts by mass of the magnetic carrier core. In the case where part of the hydroxy group of the resin is esterified with the compound represented by the formula (1), the above-mentioned content also includes the amount of the compound represented by the formula (1) subjected to the esterification.

Examples of the fatty acid having 9 or more carbon atoms include nonanoic acid, decanoic acid, lauric acid (dodecanoic acid), myristic acid (tetradecanoic acid), stearic acid (octadecanoic acid), behenic acid (docosanoic acid), octacosanoic acid, and triacontanoic acid.

Of those compounds each represented by the formula (1), an ester compound of a fatty acid is preferred. Of those ester compounds of a fatty acid, stearyl stearate or behenyl behenate is preferred.

The magnetic carrier core before treatment is described.

The magnetic carrier particles included in the magnetic carrier of the present invention each include a magnetic carrier core containing a magnetic material and a resin having a hydroxy group.

Examples of the magnetic carrier core containing a magnetic material and a resin include: magnetic material-dispersed resin particles each having a magnetic material dispersed in a resin; and resin-filled porous magnetic particles each having a resin filled into pores of the porous magnetic particles.

Those particles can reduce the true density of the magnetic carrier core, and hence can alleviate a load on toner and are less liable to destroy toner particles. This leads to less degradation in image quality even when the magnetic carrier is used at a high speed and continuously for a long period of time. Besides, the exchange frequency of a two-component developer containing toner and the magnetic carrier can be reduced.

The magnetic material-dispersed resin particles are described.

Examples of the magnetic material to be used in the magnetic material-dispersed resin particles include magnetic inorganic compound particles such as: magnetite particles; maghemite particles; magnetic iron oxide particles in which magnetite particles or maghemite particles contain at least one kind selected from the group consisting of silicon oxide, silicon hydroxide, aluminum oxide, and aluminum hydroxide; magnetoplumbite-type ferrite particles containing at least one kind selected from the group consisting of barium and strontium; and a spinel-type ferrite particles containing at least one kind selected from the group consisting of manganese, nickel, zinc, lithium, and magnesium. Of those, magnetic iron oxide particles are preferred.

In addition, the following non-magnetic inorganic compound particles may be used in combination with the above-mentioned magnetic materials (magnetic inorganic compound particles): non-magnetic iron oxide particles such as hematite particles; non-magnetic ferric oxyhydroxide particles such as goethite particles; titanium oxide particles; silica particles; talc particles; alumina particles; barium sulfate particles; barium carbonate particles; cadmium yellow particles; calcium carbonate particles; zinc oxide particles; and the like.

When the magnetic inorganic compound particles and the non-magnetic inorganic compound particles are used in combination, the mixed ratio between those particles is preferably set so that the content of the magnetic inorganic compound particles is 30 mass % or more with respect to the total mass of both the particles.

In the present invention, it is preferred that the magnetic inorganic compound particles and the non-magnetic inorganic compound particles be each entirely or partly treated with a lipophilic treatment agent.

Examples of the lipophilic treatment agent include: organic compounds each having at least one kind of functional group selected from the group consisting of an epoxy group, an amino group, a mercapto group, an organic acid group, an ester group, a ketone group, a halogenated alkyl group, and an aldehyde group; and mixtures of these organic compounds.

Coupling agents are preferred as the organic compounds each having a functional group. Out of the coupling agents, a silane coupling agent, a titanium coupling agent, and an aluminum coupling agent are more preferred. Of those, a silane-based coupling agent is more preferred.

As the resin included in the magnetic material-dispersed resin particles, a thermosetting resin is preferred.

Examples of the thermosetting resin include a phenol resin, an epoxy resin, and an unsaturated polyester resin. Of those, a phenol resin is preferred from the viewpoints of cost and ease of production.

The ratio of the resin included in the magnetic material-dispersed resin particles is preferably 1 mass % or more and 20 mass % or less with respect to the total mass of the magnetic material-dispersed resin particles. In addition, the ratio of the magnetic material (magnetic inorganic compound particles) is preferably 80 mass % or more and 99 mass % or less with respect to the total mass of the magnetic material-dispersed resin particles.

A production method for the magnetic material-dispersed resin particles is described.

The magnetic material-dispersed resin particles may be produced by, for example, the following procedure: first, a phenol and an aldehyde are put in an aqueous medium under the presence of the magnetic inorganic compound particles/the non-magnetic inorganic compound particles and a basic catalyst, followed by stirring; and then the phenol and the aldehyde are allowed to react with each other to be cured, to thereby produce the magnetic material-dispersed resin particles containing the magnetic inorganic compound particles/the non-magnetic inorganic compound particles and the phenol resin. Alternatively, the magnetic material-dispersed resin particles may be produced by, for example, a so-called kneading pulverization method involving pulverizing a resin containing the magnetic inorganic compound particles/the non-magnetic inorganic compound particles. The former method is preferred from the viewpoints of easy controllability of the particle diameter of the magnetic carrier, and sharp particle size distribution of the magnetic carrier.

The resin-filled porous magnetic particles are described.

As a material for the porous magnetic particles, there are given magnetite, ferrite, and the like. Of those, ferrite is preferred from the viewpoints of easy controllability of a porous structure, and easy resistance adjustability.

Ferrite is a sintered material represented by the following formula (2).

$$(M^{1}{}_{2}O)_{x}(M^{2}O)_{y}(Fe_{2}O_{3})_{z} \quad (2)$$

(In the formula (2), $M^1$ represents a monovalent metal atom, $M^2$ represents a divalent metal atom, x, y, and z satisfy a relationship of $x+y+z=1.0$, x satisfies a relationship of $0 \leq x \leq 0.8$, y satisfies a relationship of $0 \leq y \leq 0.8$, and z satisfies a relationship of $0.2 < z < 1.0$, provided that the case where both x and y represent 0 is excluded.)

In the formula (2), it is preferred that $M^1$ and $M^2$ each represent a metal atom selected from the group consisting of Li, Fe, Mn, Mg, Sr, Cu, Zn, and Ca. In addition, $M^1$ and/or $M^2$ may represent Ni, Co, Ba, Y, V, Bi, In, Ta, Zr, B, Mo, Na, Sn, Ti, Cr, Al, Si, or a rare earth atom.

The porous magnetic particles to be used in the magnetic carrier core are each required to maintain an appropriate magnetization amount, have an appropriate pore size, and achieve an appropriate irregularity state on the surface thereof.

In the case of employing ferrite as the material for the porous magnetic particles, it is also necessary that the rate of a ferrite forming reaction can be easily controlled and the specific resistance and magnetic force of the porous magnetic particles can be appropriately controlled. From such viewpoints, ferrite containing Mn is preferred out of ferrites. Specifically, Mn-based ferrite, Mn—Mg-based ferrite, Mn—Mg—Sr-based ferrite, or Li—Mn-based ferrite is preferred.

A production method for the resin-filled porous magnetic particles is described.

<Step 1 (Weighing/Mixing Step)>

Raw materials for ferrite are weighed and mixed with each other. Examples of the raw materials for ferrite include particles of a metal included in ferrite, particles of an oxide of the metal, particles of a hydroxide of the metal, particles of an oxalate of the metal, and particles of a carbonate of the metal.

As an apparatus for mixing the raw materials for ferrite, there are given a ball mill, a planetary mill, a giotto mill, a vibrating mill, and the like. Of those, a ball mill is preferred from the viewpoint of mixability. Specifically, it is preferred that the raw materials for ferrite after being weighed be put in a ball mill together with a ball, and then pulverized to be mixed with each other for a time period within a range of from 0.1 hour or more to 20.0 hours or less.

<Step 2 (Provisional Baking Step)>

The raw materials for ferrite after being pulverized to be mixed with each other in Step 1 are subjected to provisional baking at a baking temperature within a range of from 700° C. or more to 1,200° C. or less for a time period within a range of from 0.5 hour or more to 5.0 hours or less in the atmosphere, to be ferritized. Thus, provisionally baked ferrite is obtained. As a furnace to be used for the baking, there are given a burner-type baking furnace, a rotary-type baking furnace, an electric furnace, and the like.

<Step 3 (Pulverization Step)>

The provisionally baked ferrite obtained in Step 2 is pulverized with a pulverizer, to obtain a pulverized product of the provisionally baked ferrite.

Examples of the pulverizer include a crusher, a hammer mill, a ball mill, a bead mill, a planetary mill, and a giotto mill.

In the case of using a ball mill or a bead mill, it is preferred to control the material or size of a ball or bead, the time period of the pulverization (operation time period), or the like in order to obtain a pulverized product of the provisionally baked ferrite having a desired particle diameter. Specifically, a pulverized product of the provisionally baked ferrite having a small particle diameter may be obtained by using a ball or bead having a high specific gravity or by prolonging the time period of the pulverization. In addition, a pulverized product of the provisionally baked ferrite having a wide particle size distribution may be obtained by using a ball or bead having a high specific gravity or by shortening the time period of the pulverization. Alternatively, such pulverized product of the provisionally baked ferrite having a wide particle size distribution may be obtained by mixing a plurality of pulverized products of the provisionally baked ferrite having different particle diameters.

In addition, in the case of using a ball mill or a bead mill, a wet process exhibits higher pulverization efficiency than a dry process because the pulverized product of the provisionally baked ferrite flies up in a fewer amount in the wet process. Therefore, a wet process is preferred to a dry process.

<Step 4 (Granulation Step)>

Water and a binding material, and as required, a pore controlling agent are added to the pulverized product of the provisionally baked ferrite obtained in Step 3.

As the pore controlling agent, there are given a blowing agent, resin particles, and the like.

Examples of the blowing agent include sodium hydrogen carbonate, potassium hydrogen carbonate, lithium hydrogen carbonate, ammonium hydrogen carbonate, sodium carbonate, potassium carbonate, lithium carbonate, and ammonium carbonate.

Examples of the resin particles include particles of resins such as: a polyester; polystyrene; a styrene copolymer, e.g., a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-vinyl methyl ketone copolymer, a styrene-butadiene copolymer, a styrene-isoprene copolymer, or a styrene-acrylonitrile-indene copolymer; polyvinyl chloride; a phenol resin; a modified phenol resin; a maleic resin; an acrylic resin; a methacrylic resin; polyvinyl acetate; a silicone resin; a polyester having as structural units monomers selected from an aliphatic polyhydric alcohol, an aliphatic dicarboxylic acid, an aromatic dicarboxylic acid, an aromatic dialcohol, and a diphenol; polyurethane; polyamide; polyvinyl butyral; a terpene resin; a coumaroneindene resin; a petroleum resin; and a hybrid resin having a polyester unit and a vinyl-based polymer unit.

An example of the binding material is polyvinyl alcohol.

In the case where the pulverization in Step 3 is performed by a wet process, it is preferred to add the binding material, and as required, the pore controlling agent in consideration of water contained in a ferrite slurry.

The obtained ferrite slurry is dried and granulated with a spray drying machine in an atmosphere warmed to 100° C. or more and 200° C. or less, to obtain a granulated product. As the spray drying machine, for example, a spray dryer may be used.

<Step 5 (Main Baking Step)>

The granulated product obtained in Step 4 is baked at a temperature within a range of from 800° C. or more to 1,400° C. or less for a time period within a range of from 1 hour or more to 24 hours or less. When the baking is performed at a higher baking temperature or for a longer time period, the baking of the porous magnetic particles proceeds. As a result, the pore size and the number of pores tend to reduce.

<Step 6 (Sorting Step)>

The particles obtained through the main baking are shredded, and then coarse particles or fine particles may be removed as required by classification or sieving. The 50% particle diameter on a volume distribution basis (D50) of the magnetic carrier core is preferably 18.0 μm or more and 68.0 μm or less from the viewpoints of suppressing carrier adhesion to an output image and reducing roughness of the output image.

The porous magnetic particles may each have low physical strength depending on its internal pore volume. Therefore, in order to use the porous magnetic particles as the magnetic carrier core, it is preferred to fill a resin into at least part of the pores of the porous magnetic particles. The amount of the resin to be filled into the porous magnetic particles is preferably 2 mass % or more and 15 mass % or less with respect to the total mass of the porous magnetic particles before filling of the resin. The resin may be filled into only part of the pores or into only the pores near the surfaces of the porous magnetic particles with voids remaining inside, as long as the content (filled amount) of the resin for each magnetic carrier core has a small variation. The pores of the porous magnetic particles may be entirely filled with the resin.

As a method of filling the resin into the pores of the porous magnetic particles, there is given, for example, a method involving: first dissolving a resin in a solvent to prepare a resin solution; adding the resin solution to the pores of the porous magnetic particles by an immersion method, a spray method, a brush coating method, or the like; and then evaporating the solvent. In addition, there is given a method involving: impregnating the porous magnetic particles with the resin solution by application means such as a fluidized bed; and then evaporating the solvent. Examples of the solvent to be used in the resin solution include organic solvents such as toluene, xylene, cellosolve butyl acetate, methyl ethyl ketone (MEK), methyl isobutyl ketone, and methanol. In addition, water may be used as the solvent in the case of a water-soluble resin or an emulsion-type resin.

The amount of the resin in the resin solution is preferably 1 mass % or more and 50 mass % or less, more preferably 1 mass % or more and 40 mass % or less, with respect to the total mass of the resin solution. When the amount of the resin is 50 mass % or less, the resin solution has a low viscosity, and hence easily uniformly penetrates into the pores of the porous magnetic particles. In addition, when the amount of the resin is 1 mass % or more, a sufficient amount of the resin is easily filled into the porous magnetic particles.

As the resin having a hydroxy group to be filled into the pores of the porous magnetic particles, a thermoplastic resin or a thermosetting resin may be used. The resin to be filled into the pores of the porous magnetic particles preferably has high affinity for the porous magnetic particles. A resin having high affinity is easily filled into the pores of the porous magnetic particles, and easily coats the surfaces of the porous magnetic particles.

As the resin to be filled into the pores of the porous magnetic particles, examples of the thermoplastic resin include a novolac resin, a saturated alkyl polyester, polyarylate, and polyamide. In addition, examples of the thermosetting resin include a phenol resin, an epoxy resin, and an unsaturated polyester resin.

Immediately before the compound represented by the formula (1) is incorporated into the surface portion of the magnetic carrier core, the magnetic carrier core before the incorporation is preferably heated and dried under reduced pressure from the viewpoint of improving the environmental stability of the magnetic carrier. In addition, in the case where part of the hydroxy group of the resin included in the magnetic carrier core is esterified with the compound represented by the formula (1), the magnetic carrier core before the esterification is preferably heated and dried under reduced pressure immediately before the esterification from the same viewpoint.

The magnetic carrier particles included in the magnetic carrier of the present invention each include a resin coating layer formed on the surface of the magnetic carrier core.

By coating the surface of the magnetic carrier core with a resin, the ratio or area of a magnetic material moiety can be controlled with higher accuracy, and hence the magnetic carrier has improved environmental stability. In addition, the surface of the magnetic carrier core is preferably coated with a resin also from the viewpoints of controlling releasability of toner from the surfaces of the magnetic carrier particles, a fouling property of toner particles or external additive on the surfaces of the magnetic carrier particles, a charge imparting property to the toner, and the resistance of the magnetic carrier.

As a method of coating the surface of the magnetic carrier core of the present invention with a resin, there is given, for example, a method involving first dissolving a resin in a solvent to prepare a resin solution, and then applying the resin solution by an application method such as an immersion method, a spray method, a brush coating method, a dry method, or a method using a fluidized bed, followed by drying, to thereby coat the surface of the magnetic carrier core with the resin. Of those application methods, an immersion method is preferred because the method allows the magnetic carrier core to be moderately exposed on the surface. The coating amount of the resin is preferably 0.1 part by mass or more and 5.0 parts by mass or less with respect to 100 parts by mass of the magnetic carrier core.

A toner to be used in combination with the magnetic carrier of the present invention is described.

The toner contains toner particles, and as required, an external additive (inorganic fine particles).

As a binder resin to be used in the toner particles, there are given a vinyl-based resin, a polyester, an epoxy resin, and the like. Of those, a vinyl-based resin or a polyester is preferred from the viewpoints of chargeability and fixability.

In the present invention, the binder resin may be mixed with a homopolymer or copolymer of a vinyl-based monomer, a polyester, polyurethane, an epoxy resin, polyvinyl butyral, rosin, modified rosin, a terpene resin, a phenol resin, an aliphatic or alicyclic hydrocarbon resin, an aromatic petroleum resin, or the like before use, as required.

In the case where two or more kinds of resins are mixed to be used as the binder resin for the toner particles, it is preferred to use a mixture of resins having different molecular weights.

The glass transition temperature of the binder resin is preferably 45° C. or more and 80° C. or less, more preferably 55° C. or more and 70° C. or less.

The number average molecular weight (Mn) of the binder resin is preferably 2,500 or more and 50,000 or less.

The weight average molecular weight (Mw) of the binder resin is preferably 10,000 or more and 1,000,000 or less.

The polyester is preferably a polyester containing 45 mol % or more and 55 mol % or less of an alcohol component and 55 mol % or less and 45 mol % or more of an acid component with respect to all the components of the polyester.

The acid value of the polyester is preferably 90 mgKOH/g or less, more preferably 50 mgKOH/g or less. In addition, the hydroxy value of the polyester is preferably 50 mgKOH/g or less, more preferably 30 mgKOH/g or less. This is because the charging characteristics of the toner tends to be less dependent on an environment as the number of terminal groups in the molecular chain of the polyester becomes smaller.

The glass transition temperature of the polyester is preferably 50° C. or more and 75° C. or less, more preferably 55° C. or more and 65° C. or less.

The number average molecular weight (Mn) of the polyester is preferably 1,500 or more and 50,000 or less, more preferably 2,000 or more and 20,000 or less.

The weight average molecular weight (Mw) of the polyester is preferably 6,000 or more and 100,000 or less, more preferably 10,000 or more and 90,000 or less.

When a magnetic toner is used as the toner, as the magnetic material contained in the magnetic toner particles serving as a constituent of the magnetic toner, there are given, for example, iron oxides such as magnetite, maghemite, and ferrite, and other iron oxides containing metal oxides, metals such as Fe, Co, and Ni, or alloys of the metals with metals such as Al, Co, Cu, Pb, Mg, Ni, Sn, Zn, Sb, Be, Bi, Cd, Ca, Mn, Se, Ti, W, and V, and mixtures thereof.

More specific examples of the magnetic material include triiron tetraoxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron (Fe), cobalt (Co), and nickel (Ni).

The content of the magnetic material in the magnetic toner particles is preferably 20 parts by mass or more and 150 parts by mass or less, more preferably 50 parts by mass or more and 130 parts by mass or less, still more preferably 60 parts by mass or more and 120 parts by mass or less with respect to 100 parts by mass of the binder resin in the magnetic toner particles.

A non-magnetic colorant to be used in the toner particles includes the following.

A colorant for black toner is exemplified by: carbon black; and a colorant adjusted to a black color by using a yellow colorant, a magenta colorant, and a cyan colorant.

A colorant for magenta toner is exemplified by: a condensed azo compound, a diketopyrrolopyrrole compound, anthraquinone, a quinacridone compound, a basic dye lake compound, a naphthol compound, a benzimidazolone compound, a thioindigo compound, and a perylene compound. Specific examples thereof include pigments such as: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 2546, or 269; C.I. Pigment Violet 19; and C.I. Vat Red 1, 2, 10, 13, 15, 23, 29, or 35.

The colorant for magenta toner is also exemplified by: oil-soluble dyes such as C.I. Solvent Red 1, 3, 8, 23, 24, 25, 27, 30, 49, 81, 82, 83, 84, 100, 109, or 121, C.I. Disperse Red 9, C.I. Solvent Violet 8, 13, 14, 21, or 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, or 40, and C.I. Basic Violet 1, 3, 7, 10, 14, 15, 21, 25, 26, 27, or 28.

A colorant for cyan toner is exemplified by pigments such as: C.I. Pigment Blue 1, 2, 3, 7, 15:2, 15:3, 15:4, 16, 17, 60, 62, or 66; C.I. Vat Blue 6; C.I. Acid Blue 45; and a copper phthalocyanine pigment having a phthalocyanine skeleton with 1 or more and 5 less phthalimidomethyl substituents.

A colorant for yellow toner is exemplified by pigments such as a condensed azo compound, an isoindolinone compound, an anthraquinone compound, an azo metallic compound, a methine compound, and an allylamide compound. Specific examples thereof include: C.I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, or 191; and C.I. Vat Yellow 1, 3, or 20.

The colorant for yellow toner is also exemplified by dyes such as C.I. Direct Green 6, C.I. Basic Green 4, C.I. Basic Green 6, and C.I. Solvent Yellow 162 may be used.

As the colorant, the pigment may be used alone, or may be used in combination with the dye with a view to improving definition or improving the image quality of a full-color image.

The content of the colorant in the toner particles is preferably 0.1 part by mass or more and 30 parts by mass or less, more preferably 0.5 part by mass or more and 20 parts by mass or less, still more preferably 3 parts by mass or more and 15 parts by mass or less, with respect to 100 parts by mass of the binder resin in the toner particles.

In addition, in the production of the toner particles, it is preferred to use a master batch (colorant master batch) formed by mixing a colorant with a binder resin in advance. Then, the colorant master batch and other raw materials (such as a binder resin and a wax) may be melt-kneaded to disperse the colorant in toner particles satisfactorily.

A charge control agent may be incorporated into the toner particles included in the toner, as required, so as to stabilize the chargeability.

The content of the charge control agent in the toner particles is preferably 0.5 part by mass or more and 10 parts by mass or less with respect to 100 parts by mass of the binder resin in the toner particles. When the content of the charge control agent is 0.5 part by mass or more, a more sufficient charging characteristics are obtained. When the content of the charge control agent is parts by mass or less, its compatibility with other materials hardly lowers, and the toner is hardly excessively charged in a low-humidity environment.

The charge control agent includes the following.

As a negative charge control agent for controlling the toner particles so that the toner particles are negatively chargeable, there are given an organometallic complex, a chelate compound, and the like. Specific examples thereof include a monoazo metal complex, an aromatic hydroxycarboxylic acid metal complex, and an aromatic dicarboxylic acid-based metal complex. Further specific examples thereof include an aromatic hydroxycarboxylic acid, aromatic mono- and polycarboxylic acids and metal salts thereof, anhydrides thereof, or esters thereof, and a phenol derivative of bisphenol.

As a positive charge control agent for controlling the toner particles so that the toner particles are positively chargeable, there are given, for example, nigrosine and denatured products thereof with fatty acid metal salts and the like, onium salts such as quaternary ammonium salts such as tributylbenzylammonium-1-hydroxy-4-naphthosulfonate and tetrabutylammonium tetrafluoroborate and phosphonium salts, triphenylmethane dyes, lake pigments thereof (lake agents include phosphotungstic acid, phosphomolybdic acid, phosphotungsten molybdic acid, tannic acid, lauric acid, gallic acid, ferricyanic acid, and a ferrocyanide), and diorganotin oxides such as dibutyltin oxide, dioctyltin oxide, and dicyclohexyltin oxide, and diorganotin borates such as dibutyltin borate, dioctyltin borate, and dicyclohexyltin borate.

One or more kinds of release agents may be incorporated into the toner particles as required.

Examples of the release agents include low-molecular-weight polyethylene, low-molecular-weight polypropylene, and aliphatic hydrocarbon-based waxes such as a microcrystalline wax and a paraffin wax.

Further examples of the release agents include: oxides of aliphatic hydrocarbon-based waxes such as a polyethylene oxide wax or block copolymers thereof; waxes mainly including fatty acid esters such as a carnauba wax, a Sasol wax, and a montanic acid ester wax; and partially or wholly deoxidized fatty acid esters such as a deoxidized carnauba wax.

The content of the release agent in the toner particles is preferably 0.1 part by mass or more and 20 parts by mass or less, more preferably 0.5 part by mass or more and 10 parts by mass or less, with respect to 100 parts by mass of the binder resin in the toner particles.

In addition, the melting point of the release agent defined by a maximum endothermic peak temperature at the time of temperature rise measured with a differential scanning calorimeter (DSC) is preferably 65° C. or more and 130° C. or less, more preferably 80° C. or more and 125° C. or less. When the melting point is 65° C. or more, the viscosity of the toner hardly lowers, and the toner hardly adheres to an electrophotographic photosensitive member. When the melting point is 130° C. or less, the fixability is sufficiently obtained at low temperature.

An external additive (flowability improver) may be externally added to the toner particles from the viewpoint of improving flowability.

Examples of the external additive include: fluorine atom-containing resin particles such as vinylidene fluoride particles and polytetrafluoroethylene particles; silica particles such as wet process silica particles and dry process silica particles; and inorganic particles such as titanium oxide particles and alumina particles. The inorganic particles are preferably subjected to hydrophobizing treatment through surface treatment with a silane coupling agent, a titanium coupling agent, silicone oil, or the like. Specifically, inorganic oxide particles subjected to such treatment so as to show a hydrophobicity degree within a range of from 30 or more to 80 or less measured by a methanol titration test are preferred.

The content of the external additive in the toner is preferably 0.1 part by mass or more and 10 parts by mass or less, more preferably 0.2 part by mass or more and 8 parts by mass or less, with respect to 100 parts by mass of the toner particles.

When the magnetic carrier of the present invention is mixed with the toner and used as a two-component developer, the content of the toner (toner concentration) in the two-component developer is preferably 2 mass % or more and 15 mass % or less, more preferably 4 mass % or more and 13 mass % or less, with respect to the total mass of the two-component developer. When the content of the toner is 2 mass % or more, an output image density hardly lowers. When the content of the toner is 15 mass % or less, fogging in an output image and toner scattering in an image forming apparatus (in-machine scattering) hardly occur.

In addition, in a replenishing developer to be replenished to a developing unit in accordance with a decrease in toner concentration in the two-component developer in a developing device, the content of replenishing toner is preferably 2 parts by mass or more and 50 parts by mass or less with respect to 1 part by mass of a replenishing magnetic carrier.

An image forming apparatus (electrophotographic apparatus) including a developing device using the two-component developer and replenishing developer containing the magnetic carrier is described.

<Image Forming Method>

Figure 2:
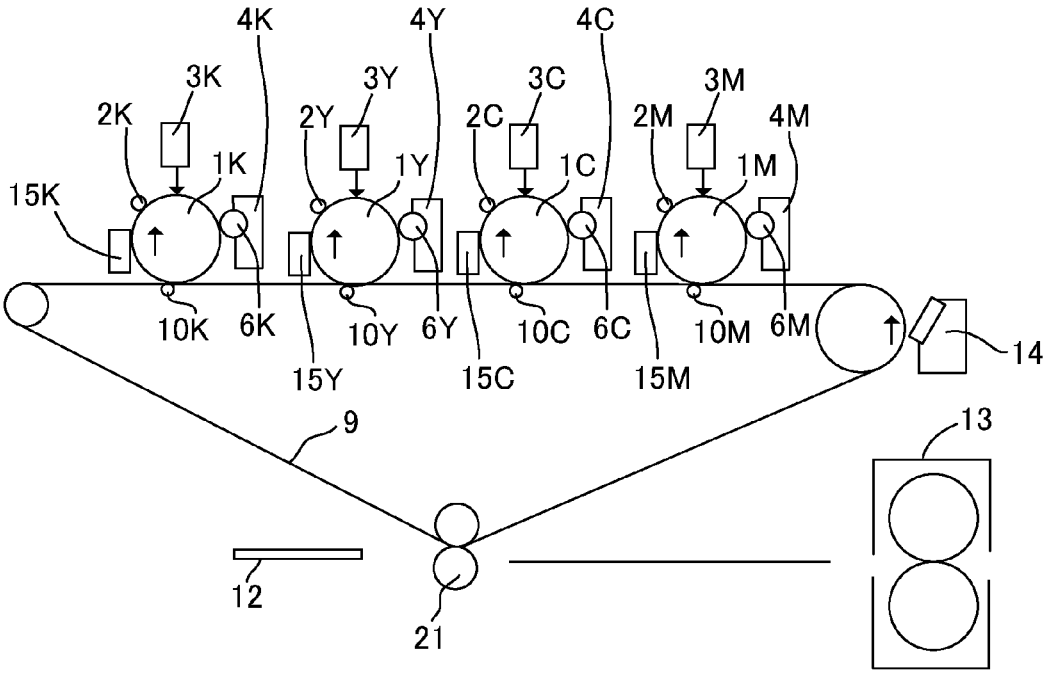
FIG. 2 is a schematic view of an image forming apparatus used in the present invention.

In FIG. 1, an electrophotographic photosensitive member 1 as an electrostatic latent image bearing member is configured to rotate in the arrow direction of FIG. 1. The surface of the electrophotographic photosensitive member 1 is charged with a charging unit 2 as charging device, and the charged surface of the electrophotographic photosensitive member 1 is irradiated with image exposure light from an image exposure unit 3 as image exposure device (electrostatic latent image forming device) to form an electrostatic latent image. A developing unit 4 as developing device includes a developer container 5 configured to accommodate the two-component developer. A developer carrying member 6 is arranged in a rotatable state in the developing unit 4. The developer carrying member 6 includes magnets 7 in the inside thereof as magnetic field generating device. At least one of the magnets 7 is arranged at a position facing the electrophotographic photosensitive member 1. The two-component developer is held on the developer carrying member 6 by a magnetic field generated by the magnets 7. The amount of the two-component developer is controlled with a control member 8, and the two-component developer is conveyed to a developing zone facing the electrophotographic photosensitive member 1. In the developing zone, a magnetic brush is formed by the magnetic field generated by the magnets 7. After that, a developing bias formed by superimposing an alternating electric field on a direct current electric field is applied to the developer carrying member, and the electrostatic latent image is developed (visualized) as a toner image. The toner image formed on the surface of the electrophotographic photosensitive member 1 is electrostatically transferred onto a recording medium (transfer material) 12 with a transfer charging unit 11 as transfer device. Herein, as illustrated in FIG. 2, the toner image may be once transferred (primarily transferred) from the electrophotographic photosensitive member 1 onto an intermediate transfer member 9, and then electrostatically transferred (secondarily transferred) onto the recording medium 12. After that, the recording medium 12 is conveyed to a fixing unit 13 as fixing device. The toner is fixed onto the recording medium 12 through heating and pressurization in the fixing unit 13. After that, the recording medium 12 is discharged from the image forming apparatus as an output image. After the transfer step, the toner remaining on the surface of the electrophotographic photosensitive member 1 (transfer residual toner) is removed with a cleaner 15 as cleaning device. After that, the surface of the electrophotographic photosensitive member 1 cleaned by the cleaner 15 is irradiated with pre-exposure light from a pre-exposure unit 16 as pre-exposure device to be electrically initialized, and the above-mentioned image forming operations are repeated.

FIG. 2 illustrates an example of a schematic view in the case of applying the image forming method of the present invention to a full-color image forming apparatus.

Symbols K, Y, C, and M in FIG. 2 represent black, yellow, cyan, and magenta, respectively. In FIG. 2, electrophotographic photosensitive members 1K, 1Y, 1C, and 1M are configured to rotate in the respective arrow directions of FIG. 2. The surfaces of the electrophotographic photosensitive members 1K, 1Y, 1C, and 1M are charged with charging units 2K, 2Y, 2C, and 2M as charging device, respectively. The charged surfaces of the electrophotographic photosensitive members 1K, 1Y, 1C, and 1M are irradiated with image exposure light from image exposure units 3K, 3Y, 3C, and 3M as image exposure device (electrostatic latent image forming device), respectively, to form electrostatic latent images. After that, the electrostatic latent images are developed (visualized) as toner images with the two-component developers carried on developer carrying members 6K, 6Y, 6C, and 6M provided in developing units 4K, 4Y, 4C, and 4M as developing device, respectively. The toner images are transferred (primarily transferred) onto the intermediate transfer member 9 with primary transfer charging units 10K, 10Y, 10C, and 10M as primary transfer device. Further, the toner images are transferred (secondarily transferred) onto the recording medium 12 with a secondary transfer charging unit 21 as secondary transfer device. After that, the recording medium 12 is conveyed to the fixing unit 13 as fixing device, and the toner is fixed onto the recording medium 12 through heating and pressurization. After that, the recording medium 12 is discharged from the image forming apparatus as an output image. After the secondary transfer step, transfer residual toner and the like are removed with an intermediate transfer member cleaner 14 as cleaning device for the intermediate transfer member 9. It should be noted that, after the primary transfer step, the toners remaining on the surfaces of the electrophotographic photosensitive members 1K, 1Y, 1C, and 1M are removed with cleaners 15K, 15Y, 15C, and 15M as cleaning device, respectively.

A developing method using the two-component developer of the present invention preferably involves developing in a state in which the magnetic brush is brought into contact with the electrophotographic photosensitive member, while an alternating voltage is applied to the developer carrying member to form the alternating electric field in the developing zone. The distance between the developer carrying member (developing sleeve (S)) 6 and the electrophotographic photosensitive member (photosensitive drum (D)) (S-D gap) is preferably 100 μm or more and 1,000 μm or less from the viewpoints of preventing the carrier adhesion and improving dot reproducibility. When the S-D gap is 100 μm or more, the two-component developer is sufficiently supplied, and the output image density hardly lowers. When the S-D gap is 1,000 μm or less, a magnetic line of force from a magnetic pole S1 hardly spreads, and hence the density of the magnetic brush hardly lowers, and the dot reproducibility hardly lowers. In addition, a confining force on the magnetic carrier hardly lowers, and the adhesion of the magnetic carrier hardly occurs.

The peak-to-peak voltage (Vpp) of the alternating electric field is preferably 300 V or more and 3,000 V or less, more preferably 500 V or more and 1,800 V or less. In addition, the frequency of the alternating electric field is preferably 500 Hz or more and 10,000 Hz or less, more preferably 1,000 Hz or more and 7,000 Hz or less. In this case, as a waveform of an alternating current bias for forming the alternating electric field, there are given a triangular wave, a rectangular wave, a sinusoidal wave, a waveform changed in duty ratio, and the like. In order to correspond to changes in toner image forming rate, the developing is preferably performed while a developing bias voltage including a discontinuous alternating current bias voltage (intermittent alternating superimposed voltage) is applied to the developer carrying member. When the applied voltage is 300 V or more, a sufficient image density is easily obtained, and fogging toner in a non-image area is easily recovered. In addition, when the applied voltage is 3,000 V or less, the magnetic brush hardly causes a disturbance in the electrostatic latent image.

The use of the two-component developer containing sufficiently charged toner allows for a reduction in fog removing voltage (Vback), and allows the primary charging of the electrophotographic photosensitive member to be lowered. Therefore, the lifetime of the electrophotographic photosensitive member can be prolonged. The Vback is preferably 200 V or less, more preferably 150 V or less. A contrast potential is preferably 100 V or more and 400 V or less from the viewpoint of attaining a sufficient image density.

In addition, when the frequency is 500 Hz or more, any electrophotographic photosensitive member to be used for a general image forming apparatus (electrophotographic apparatus) may be used. An example of such electrophotographic photosensitive member is an electrophotographic photosensitive member having a structure in which a conductive layer, an undercoat layer, a charge generating layer, and a charge transport layer are formed on a conductive support formed of aluminum, SUS, or the like in the stated order. A protective layer may be formed on the charge transport layer as required.

As the conductive layer, the undercoat layer, the charge generating layer, and the charge transport layer, those generally employed in the electrophotographic photosensitive member may be employed.

<Measurement Method for Volume Average Particle Diameter (D50) of Magnetic Carrier and Porous Magnetic Particle>

The particle size distribution was measured with a particle size distribution measuring apparatus according to a laser diffraction/scattering method (trade name: Microtrac MT3300EX manufactured by Nikkiso Co., Ltd.).

A sample feeding unit for dry process measurement (trade name: one-shot dry-type sample conditioner Turbotrac manufactured by Nikkiso Co., Ltd.) was attached to the apparatus to measure the volume average particle diameters (D50) of the magnetic carrier and the porous magnetic particles. As the supply conditions of Turbotrac, a dust collector was used as a vacuum source, the air flow rate was set to about 33 l/sec, and the pressure was set to 17 kPa. The control was automatically performed by software. A 50% particle diameter (D50) that was an accumulated value on a volume average basis was determined. The control and the analysis were performed with the attached software (version 10.3.3-202D). The measurement conditions are described below.

Set Zero time: 10 sec
Measurement time: 10 sec
Number of times of measurement: 1
Particle refractive index: 1.81%
Particle shape: non-spherical
Upper limit of measurement: 1,408 μm
Lower limit of measurement: 0.243 μm
Measurement environment: temperature: 23° C./humidity: 50% RH <Measurement Method for Weight Average Particle Diameter (D4) and Number Average Particle Diameter (D1) of Toner>

The weight average particle diameter (D4) and number average particle diameter (D1) of the toner were measured by using a precision particle size distribution measuring apparatus based on a pore electrical resistance method provided with a 100-μm aperture tube (trade name: Coulter Counter Multisizer 3, manufactured by Beckman Coulter, Inc.) and dedicated software included therewith (trade name:

Beckman Coulter Multisizer 3 Version 3.51, manufactured by Beckman Coulter, Inc.) for setting measurement conditions and analyzing measurement data. The number of effective measurement channels was 25,000. The measurement data was analyzed to calculate the diameters.

An electrolyte solution prepared by dissolving reagent grade sodium chloride in ion-exchanged water so as to have a concentration of 1 mass % (trade name: ISOTON II, manufactured by Beckman Coulter, Inc.) was used in the measurement.

It should be noted that the dedicated software is set as described below prior to the measurement and the analysis.

In the "change standard measurement method (SOM)" screen of the dedicated software, the total count number of a control mode was set to 50,000 particles, the number of times of measurement was set to 1, and a Kd value was set to a value obtained by using "standard particles each having a particle diameter of 10.0 μm" (manufactured by Beckman Coulter, Inc.). A threshold and a noise level were automatically set by pressing a threshold/noise level measurement button. In addition, a current was set to 1,600 μA, a gain was set to 2, and an electrolyte solution is set to "ISOTON II", and a check mark was placed in a check box as to whether the aperture tube was flushed after the measurement.

In the "setting for conversion from pulse to particle diameter" screen of the dedicated software, a bin interval was set to a logarithmic particle diameter, the number of particle diameter bins was set to 256, and a particle diameter range was set to the range of from 2 μm to 60 μm.

A specific measurement method is as described below.

(1) 200 ml of the electrolyte solution were charged into a 250-ml round-bottom beaker made of glass dedicated for "Multisizer 3". The beaker was set in a sample stand, and the electrolyte solution in the beaker was stirred with a stirrer rod under the condition of 24 rotations/sec in a counter-clockwise direction. Then, dirt and bubbles in the aperture tube were removed by the "aperture flush" function of the dedicated software.

(2) 30 ml of the electrolyte solution were charged into a 100-ml flat-bottom beaker made of glass. 0.3 ml of a diluted solution prepared by diluting a dispersant (trade name: Contaminon N, manufactured by Wako Pure Chemical Industries, Ltd.) with ion-exchanged water 3-fold (mass ratio) was added to the electrolyte solution. "Contaminon N" is a 10 mass % aqueous solution of a neutral detergent for washing a precision measuring device formed of a nonionic surfactant, an anionic surfactant, and an organic builder and having a pH of 7.

(3) Ion-exchanged water was charged into the water tank of an ultrasonic dispersing unit (trade name: Ultrasonic Dispersion System Tetra 150, manufactured by Nikkaki Bios Co., Ltd.) in which two oscillators each having an oscillatory frequency of 50 kHz were built so as to be out of phase by 180° and which had an electrical output of 120 W. 2 ml of "Contaminon N" were added to the water tank.

(4) The beaker in the section (2) was set in the beaker fixing hole of the ultrasonic dispersing unit, and the ultrasonic dispersing unit was operated. Then, the height position of the beaker was adjusted so that the liquid level of the electrolyte solution in the beaker resonated with an ultrasonic wave from the ultrasonic dispersing unit to the fullest extent possible.

(5) 10 mg of toner were gradually added to and dispersed in the electrolyte solution in the beaker in the section (4) in a state in which the electrolyte solution was irradiated with the ultrasonic wave. Then, the ultrasonic dispersion treatment was continued for an additional 60 seconds. It should be noted that the temperature of water in the water tank was adjusted so as to be 10° C. or more and 40° C. or less upon ultrasonic dispersion.

(6) The electrolyte solution in the section (5) in which the toner had been dispersed was dropped with a pipette to the round-bottom beaker in the section (1) placed in the sample stand, and the concentration of the toner to be measured was adjusted to 5%. Then, measurement was performed until the number of measured particles reached 50,000.

(7) The measurement data was analyzed with the dedicated software included with the apparatus, and the weight average particle diameter (D4) and the number average particle diameter (D1) were calculated. It should be noted that an "average diameter" on the "analysis/volume statistics (arithmetic average)" screen of the dedicated software when the dedicated software is set to "graph/vol %" is the weight average particle diameter (D4). An "average diameter" on the "analysis/number statistics (arithmetic average)" screen of the dedicated software when the dedicated software is set to "graph/number %" is the number average particle diameter (D1).

<Calculation Method for Fine Powder Amount>

A fine powder (fine particle) amount on a number basis (number %) in the toner was calculated as described below.

The number % of toner particles each having a particle diameter of 4.0 μm or less in the toner was calculated as described below. After the measurement with "Multisizer 3" has been performed, (1) the chart for the results of the measurement is displayed in terms of number % by setting the dedicated software to "graph/number %", and (2) "<" of the particle diameter-setting portion in the "format/particle diameter/particle diameter statistics" screen is checked, and "4" is input in the particle diameter-inputting portion below the particle diameter-setting portion. Then, (3) the numerical value in the "<4 μm" display portion when the "analysis/number statistics (arithmetic average)" screen is displayed is the number % of the particles each having a particle diameter of 4.0 μm or less in the toner.

<Calculation Method for Coarse Powder Amount>

A coarse powder (coarse particle) amount on a volume basis (vol %) in the toner was calculated as described below.

The vol % of particles each having a particle diameter of 10.0 μm or more in the toner was calculated as described below. After the measurement with "Multisizer 3" has been performed, (1) the chart for the results of the measurement is displayed in terms of vol % by setting the dedicated software to "graph/vol %", and (2) ">" of the particle diameter-setting portion in the "format/particle diameter/particle diameter statistics" screen is checked, and "10" is input in the particle diameter-inputting portion below the particle diameter-setting portion. Then, (3) the numerical value in the ">10 μm" display portion when the "analysis/volume statistics (arithmetic average)" screen is displayed is the vol % of the particles each having a particle diameter of 10.0 μm or more in the toner.

<Measurement Method for Adsorbed Moisture Amount of Magnetic Carrier>

10 g of the magnetic carrier were weighed on a stainless plate with a precision balance, and the mass of the magnetic carrier after being left to stand in an atmosphere of a temperature of 30° C. and a humidity of 80% RH for 72 hours, (W1), was measured. After that, the magnetic carrier was left to stand in a dryer at a set temperature of 100° C. under reduced pressure for 6 hours, to be dried. The mass of the dried magnetic carrier in which moisture was removed, (W2), was measured.

The adsorbed moisture amount of the magnetic carrier was calculated according to the following equation (3).

$$\text{Adsorbed moisture amount of magnetic carrier (\%)} = (W1-W2)/W1\times100 \quad (3)$$

The present invention is more specifically described below by way of Examples. However, the present invention is not limited only to Examples.

Production Example of Magnetic Particles 1

4.0 mass % of a silane-based coupling agent (3-(2-aminoethylaminopropyl)trimethoxysilane) was added to each of magnetite particles having a number average particle diameter of 0.30 μm and hematite particles having a number average particle diameter of 0.30 μm. Then, the contents were each stirred and mixed in a container at 100° C. or more at a high speed. Thus, the particles were treated.

Phenol: 10 parts by mass

Formaldehyde solution (formaldehyde: 40%, methanol: 10%, water: 50%): 6 parts by mass Treated magnetite: 80 parts by mass Treated hematite: 4 parts by mass The above-mentioned materials, 5 parts by mass of 28% ammonia water, and 20 parts by mass of water were put in a flask. Then, while the contents were stirred and mixed, the temperature was raised to 85° C. in 30 minutes and kept at the temperature. A polymerization reaction was performed for 3 hours, to cure a phenol resin to be generated. After that, the cured phenol resin was cooled to 30° C., and water was added thereto. Then, the supernatant solution was removed, and the precipitate was air-dried after washing with water. Next, the resultant was dried at a temperature of 180° C. under reduced pressure (5 mmHg or less) for 5 hours. Thus, magnetic particles 1 as magnetic material-dispersed resin particles were obtained.

Production Example of Magnetic Particles 2

Step 1 (Weighing/Mixing step)

$Fe_2O_3$: 68.3 mass %

$MnCO_3$: 28.5 mass %

$Mg(OH)_2$: 2.0 mass %

$SrCO_3$: 1.2 mass %

The above-mentioned raw materials for ferrite were weighed, and 20 parts by mass of water were added to 80 parts by mass of the raw materials for ferrite. The mixture was pulverized to prepare a slurry. The solid content concentration of the slurry was set to 80 mass %.

Step 2 (Provisional Baking Step)

The obtained slurry was dried with a spray dryer (manufactured by OHKAWARA KAKOHKI CO., LTD.). After that, the resultant was baked at a temperature of 1,050° C. for 3.0 hours in a nitrogen atmosphere (oxygen concentration: 1.0 vol %) in a batch-type electric furnace. Thus, provisionally baked ferrite was produced.

Step 3 (Pulverizing Step)

The provisionally baked ferrite was pulverized with a crusher so as to have a particle diameter of about 0.5 mm, and then water was added thereto to prepare a slurry. The solid content concentration of the slurry was set to 70 mass %. The slurry was pulverized with a wet process bead mill using ⅛-inch beads made of stainless steel for 3 hours, to obtain a slurry. The slurry was pulverized with a wet process bead mill using zirconia beads each having a diameter of 1 mm for 4 hours. Thus, a provisionally baked ferrite slurry having a 50% particle size (D50) on a volume basis of 1.3 μm was obtained.

Step 4 (Granulation Step)

1.0 Part by mass of ammonium polycarboxylate as a dispersant and 1.5 parts by mass of polyvinyl alcohol as a binding material were added to 100 parts by mass of the provisionally baked ferrite slurry. After that, the resultant was granulated into spherical particles with a spray dryer (manufactured by OHKAWARA KAKOHKI CO., LTD.), followed by drying. The obtained granulated product was subjected to particle size control, and then heated at 700° C. for 2 hours with a rotary-type electric furnace, to remove organic materials such as the dispersant and the binding material.

Step 5 (Baking Step)

The granulated product was baked in a nitrogen atmosphere (oxygen concentration: 1.0 vol %) by raising the temperature from room temperature to a baking temperature (1,100° C.) in 2 hours and keeping the temperature at 1,100° C. for 4 hours. After that, the temperature was dropped therefrom to a temperature of 60° C. in 8 hours, and the nitrogen atmosphere was returned to the atmosphere. The granulated product was taken out at a temperature of 40° C. or less.

Step 6 (Sorting Step)

The agglomerated particles were shredded, and then subjected to sieving with a sieve having a sieve opening of 150 μm to remove coarse particles, air classification to remove fine particles, and magnetic separation to remove a low magnetic component. Thus, magnetic particles were obtained. The obtained magnetic particles each had a porous form having pores.

Step 7 (Filling Step)

100 Parts by mass of the obtained magnetic particles were put in a stirring container in a mixing stirrer (trade name: versatile mixer NDMV type, manufactured by DALTON CORPORATION), and a resin solution 1 shown in Table 1 and an acid catalyst were added thereto in drops.

Stirring was continued for 2.5 hours after the completion of the dropping, to fill a resin composition obtained from the resin solution 1 in the porous magnetic particles. Thus, filled magnetic particles 1 were obtained. The filled amount of the resin was adjusted to 4.0 parts by mass with respect to 100 parts by mass of the magnetic particles.

The obtained filled magnetic particles 1 were transferred to a mixer having a rotatable mixing container with a spiral blade (trade name: drum mixer UD-AT type, manufactured by SUGIYAMA HEAVY INDUSTRIAL CO., LTD.), and the temperature was raised at a rate of temperature rise of 2° C./min to a set temperature of the mixer, 150° C., in a nitrogen atmosphere. The filled magnetic particles 1 were heated and stirred at the temperature for 1.0 hour. Thus, the resin was cured. Further, the stirring was continued for 2.0 hours under reduced pressure.

After that, the resultant was cooled to room temperature, and ferrite particles in which the resin was filled and cured were taken out. A magnetic separator was used to remove a non-magnetic material. Further, a vibrating sieve was used to remove coarse particles. Thus, magnetic particles 2 as resin-filled porous magnetic particles were obtained.

Production Example of Magnetic Particles 3

The resin solution 1 used in the filling step of the "Production Example of Magnetic Particles 2" section was changed to a resin solution 2 shown in Table 1. The resin solution 2 was added in drops, and stirring was continued for 2.5 hours after the completion of the dropping, to fill a resin composition obtained from the resin solution 2 in the pores of the porous magnetic particles. Thus, filled magnetic particles 2 were obtained. The filled amount of the resin was adjusted to 4.0 parts by mass with respect to 100 parts by mass of the porous magnetic particles.

The obtained filled magnetic particles 2 were transferred to a mixer having a rotatable mixing container with a spiral blade (trade name: drum mixer UD-AT type, manufactured by SUGIYAMA HEAVY INDUSTRIAL CO., LTD.), and stirring was continued at a set temperature of the mixer, 80° C., for 2.0 hours under reduced pressure.

After that, the resultant was cooled to room temperature, and ferrite particles in which the resin was filled were taken out. A magnetic separator was used to remove a non-magnetic material. Further, a vibrating sieve was used to remove coarse particles. Thus, magnetic particles 3 in which the resin was filled were obtained.

It should be noted that each of the magnetic particles 1 to 3 were confirmed to include a resin having a hydroxy group on the surface portions of the magnetic particles by using a scanning electron microscope (trade name: S4700, manufactured by Hitachi, Ltd.).

Production Example of Magnetic Carrier Core 1

100.0 Parts by mass of the magnetic particles 1 were dried while being stirred at 220° C. for 6.0 hours under reduced pressure. After that, the magnetic particles 1 were cooled to normal temperature under reduced pressure, and 200.0 parts by mass of o-xylene were added thereto. Then, 1.0 part by mass of stearoyl chloride was added in drops to the mixture in 2.0 hours, while the mixture was cooled and stirred at 0° C. After the dropping, the resultant was subjected to filtration, neutralization with sodium hydroxide, washing with water, air drying, and drying under reduced pressure. Thus, a magnetic carrier core 1 was obtained.

It should be noted that the obtained magnetic carrier core 1 was washed with toluene at 70° C. and confirmed to contain 0.2 part by mass of stearic acid as an unreacted substance. In addition, infrared spectroscopic analysis confirmed that a hydroxy group existed in the obtained magnetic carrier core 1.

Production Examples of Magnetic Carrier Cores 2 and 8

100.0 Parts by mass of the magnetic particles 1 were dried while being stirred at 220° C. for 6.0 hours under reduced pressure. After that, the magnetic particles 1 were cooled to normal temperature under reduced pressure. 2.0 Parts by mass of octacosanoic acid were added to 100.0 parts by mass of the magnetic particles 1, and concentrated sulfuric acid was added thereto as a catalyst. Then, the mixture was heated and stirred at 100° C. for 1 hour. After that, the resultant was subjected to neutralization with sodium hydroxide, washing with water, air drying, and drying under reduced pressure. Thus, a magnetic carrier core 2 was obtained. It should be noted that the obtained magnetic carrier core 2 was washed with toluene at 70° C. and confirmed to contain 1.0 part by mass of octacosanoic acid as an unreacted substance. In addition, infrared spectroscopic analysis confirmed that a hydroxy group existed in the obtained magnetic carrier core 2.

In addition, 0.5 part by mass of 3-(trimethoxysilyl)propyl methacrylate shown in Table 2 and concentrated sulfuric acid as a catalyst were added to the magnetic particles 1 after the above-mentioned drying step. The mixture was heated and stirred at 50° C. for 1 hour. After that, the resultant was subjected to neutralization with sodium hydroxide, washing with water, air drying, and drying under reduced pressure. Thus, a magnetic carrier core 8 was obtained. It should be noted that the obtained magnetic carrier core 8 was washed with toluene at 70° C. and confirmed to contain 0.2 part by mass of 3-(trimethoxysilyl)propyl methacrylate as an unreacted substance. In addition, infrared spectroscopic analysis confirmed that a hydroxy group existed in the obtained magnetic carrier core 8.

Production Examples of Magnetic Carrier Cores 3 and 9

100.0 Parts by mass of the magnetic particles 1 were dried while being stirred at 220° C. for 6.0 hours under reduced pressure. After that, the magnetic particles 1 were cooled to normal temperature under reduced pressure. 2.0 Parts by mass of lauric anhydride were added to 100.0 parts by mass of the magnetic particles 1, and the mixture was stirred while being heated to 70° C. at a rate of temperature rise of 5° C. per minute. After that, the mixture was further heated and stirred for 1 hour, followed by washing with water, air drying, and drying under reduced pressure. Thus, a magnetic carrier core 3 was obtained. It should be noted that the obtained magnetic carrier core 3 was washed with toluene at 70° C. and confirmed to contain 1.5 parts by mass of lauric acid as an unreacted substance. In addition, infrared spectroscopic analysis confirmed that a hydroxy group existed in the obtained magnetic carrier core 3.

In addition, 2.0 parts by mass of stearic anhydride shown in Table 2 were added to the magnetic particles 2 after the above-mentioned drying step. The mixture was stirred while being heated to 90° C. at a rate of temperature rise of 5° C. per minute. After that, the mixture was further heated and stirred for 1 hour, followed by washing with water, air drying, and drying under reduced pressure. Thus, a magnetic carrier core 9 was obtained. It should be noted that the obtained magnetic carrier core 9 was washed with toluene at 70° C. and confirmed to contain 1.5 parts by mass of stearic acid as an unreacted substance. In addition, infrared spectroscopic analysis confirmed that a hydroxy group existed in the obtained magnetic carrier core 9.

Production Examples of Magnetic Carrier Cores 4 to 7, 10 to 13, 15, 16, and 18

100.0 Parts by mass of magnetic particles shown in Table 2 were subjected to the drying step at 220° C. for 6.0 hours under reduced pressure while being stirred, and then an intermediate treatment compound shown in Table 2 was added thereto in an amount shown in Table 2. The mixture was heated and stirred at 100° C. for 1 hour, and then cooled to normal temperature. Thus, each of magnetic carrier cores 4 to 7, 10 to 13, 15, and 16 was obtained.

In addition, a magnetic carrier core 18 was obtained in the same manner as that of the magnetic carrier core 12 except that the magnetic particles 1 were not subjected to the above-mentioned drying step.

Production Example of Magnetic Carrier Core 14

1.0 Part by mass of a silane coupling agent having an amino group KBM-602 (manufactured by Shin-Etsu Chemical Co., Ltd.) dissolved in methanol was added to 100.0 parts by mass of the magnetic particles 1. After that, the mixture was heated to 70° C., and stirred and mixed. The stirring was continued for 1 hour. Thus, a magnetic carrier core 14 was obtained.

<Magnetic Carrier Core 17>

The magnetic particles 1 without any treatment were taken as a magnetic carrier core 17.

Production Example of Magnetic Carriers 1 to 18

A resin solution 3 shown in Table 1 was loaded in a planetary motion mixer (trade name: Nauta Mixer VN type, manufactured by HOSOKAWA MICRON CORPORATION) kept at a temperature of 60° C. under reduced pressure (1.5 kPa) so that the amount of the resin was 2.0 parts by mass with respect to 100 parts by mass of the magnetic carrier core 1. The procedure of the loading was as follows: one-third of the resin solution was loaded, and its application and solvent removal were performed for 20 minutes; and then another one-third of the resin solution was loaded, and its application and solvent removal were performed for 20 minutes; and further the last one-third of the resin solution was loaded, and its application and solvent removal were performed for 20 minutes.

After that, a magnetic carrier coated with a coating resin composition was transferred to a mixer having a rotatable mixing container with a spiral blade (trade name: drum mixer UD-AT type, manufactured by SUGIYAMA HEAVY INDUSTRIAL CO., LTD.). The magnetic carrier was subjected to heat treatment at a temperature of 120° C. for 2 hours in a nitrogen atmosphere while being stirred in the mixing container rotating 10 times per minute. A magnetic carrier 1 thus obtained was subjected to magnetic separation to be separated from a low magnetic product, allowed to pass through a sieve having a sieve opening of 150 μm, and subjected to classification with an air classifier. Thus, the magnetic carrier 1 having a 50% particle diameter on a volume distribution basis (D50) of 39.5 μm was obtained.

The physical property values of the obtained magnetic carrier 1 are shown in Table 2.

Further, the magnetic carrier core 1 was changed to the magnetic carrier cores 2 to 18 shown in Table 2, and the magnetic carrier cores 2 to 18 were each coated with the resin solution 3 in the same manner as that of the magnetic carrier 1, followed by separation of a low magnetic product. In addition, the same classification step as that in the case of the magnetic carrier 1 was performed. Thus, magnetic carriers 2 to 18 each having a 50% particle diameter on a volume distribution basis (D50) of 39.5 μm were obtained. The results of the adsorbed moisture amounts are shown in Table 2.

TABLE 1

| | Resin component | | Solvent component | | Additive | |
|---|---|---|---|---|---|---|
| | Resin varnish | Mass % | Solvent kind | Mass % | Additive kind | Mass % |
| Resin solution 1 | Novolac-type phenol resin | 32.0 | MEK | 66.0 | Hexamethylenetetramine | 2.0 |
| Resin solution 2 | Bisphenol A-type polyester resin (hydroxy value: 10.0 mgKOH/g) | 30.0 | Toluene | 70.0 | — | — |
| Resin solution 3 | Copolymer of cyclohexyl methacrylate, methyl methacrylate macromonomer (Mw: 5,000) and methyl methacrylate (ratio of solid content: 40%) | 40.0 | Toluene | 56.0 | Melamine/formaldehyde condensate Epostar S6 manufactured by NIPPON SHOKUBAI CO., LTD. | 3.0 |
| | | | | | Carbon black #25 manufactured by Mitsubishi Chemical Corporation | 1.0 |

TABLE 2

| | | | Intermediate treatment compound | | Adsorbed moisture |
|---|---|---|---|---|---|
| Magnetic carrier | Magnetic carrier core | Magnetic particles | Name of compound | Treatment amount (part(s) by mass) | amount (mass %) |
| Magnetic carrier 1 | Magnetic carrier core 1 | Magnetic particles 1 | Stearoyl chloride | 1.0 | 0.15 |
| Magnetic carrier 2 | Magnetic carrier core 2 | Magnetic particles 1 | Octacosanoic acid | 2.0 | 0.18 |
| Magnetic carrier 3 | Magnetic carrier core 3 | Magnetic particles 1 | Lauric anhydride | 2.0 | 0.08 |
| Magnetic carrier 4 | Magnetic carrier core 4 | Magnetic particles 1 | Stearic acid | 2.0 | 0.24 |
| Magnetic carrier 5 | Magnetic carrier core 5 | Magnetic particles 1 | Behenyl behenate | 3.0 | 0.26 |
| Magnetic carrier 6 | Magnetic carrier core 6 | Magnetic particles 1 | Triacontanoic acid | 0.3 | 0.30 |
| Magnetic carrier 7 | Magnetic carrier core 7 | Magnetic particles 1 | Myristic acid | 0.8 | 0.31 |

TABLE 2-continued

| Magnetic carrier | Magnetic carrier core | Magnetic particles | Intermediate treatment compound: Name of compound | Intermediate treatment compound: Treatment amount (part(s) by mass) | Adsorbed moisture amount (mass %) |
|---|---|---|---|---|---|
| Magnetic carrier 8 | Magnetic carrier core 8 | Magnetic particles 1 | 3-(trimethoxysilyl)propyl methacrylate | 0.5 | 0.36 |
| Magnetic carrier 9 | Magnetic carrier core 9 | Magnetic particles 2 | Stearic anhydride | 2.0 | 0.07 |
| Magnetic carrier 10 | Magnetic carrier core 10 | Magnetic particles 2 | Behenyl behenate | 4.0 | 0.11 |
| Magnetic carrier 11 | Magnetic carrier core 11 | Magnetic particles 3 | 3-(trimethoxysilyl)propyl methacrylate | 0.5 | 0.35 |
| Magnetic carrier 12 | Magnetic carrier core 12 | Magnetic particles 1 | Nonanoic acid | 0.5 | 0.38 |
| Magnetic carrier 18 | Magnetic carrier core 18 | Magnetic particles 1 Without drying step | Nonanoic acid | 0.5 | 0.40 |
| Magnetic carrier 13 | Magnetic carrier core 13 | Magnetic particles 1 | Nonanoic acid | 0.2 | 0.42 |
| Magnetic carrier 14 | Magnetic carrier core 14 | Magnetic particles 1 | Aminosilane coupling agent | 1.0 | 0.33 |
| Magnetic carrier 15 | Magnetic carrier core 15 | Magnetic particles 1 | Heptanoic acid | 1.0 | 0.45 |
| Magnetic carrier 16 | Magnetic carrier core 16 | Magnetic particles 1 | Formic acid | 1.0 | 0.54 |
| Magnetic carrier 17 | Magnetic carrier core 17 | Magnetic particles 1 | Without treatment | 0 | 0.60 |

Production Example of Toner 1

Binder resin (polyester): 100 parts by mass

C.I. Pigment Blue 15:3 4.5 parts by mass

Aluminum 3,5-di-t-butyl salicylate compound: 0.5 part by mass

Normal paraffin wax (melting point: 78° C.): 6 parts by mass

The materials of the foregoing formulation were mixed well with a Henschel mixer (FM-75J type, manufactured by Mitsui Mining Co., Ltd.) and then kneaded with a biaxial kneader (trade name: PCM-30 type, manufactured by Ikegai Corp.) set at a temperature of 130° C. at a feed amount of 10 kg/hr (the temperature of the kneaded product at the time of its ejection was about 150° C.). The obtained kneaded product was cooled and roughly pulverized with a hammer mill and then finely pulverized with a mechanical pulverizer (trade name: T-250, manufactured by Turbo Kogyo Co., Ltd.) at a feed amount of 15 kg/hr. Thus, particles were obtained, which had a weight average particle diameter of 5.5 μm, contained particles each having a particle diameter of 4.0 μm or less at 55.6 number %, and contained particles each having a particle diameter of 10.0 μm or more at 0.8 vol %.

The obtained particles were subjected to classification for cutting off fine powder and coarse powder with a rotary classifier (trade name: TTSP100, manufactured by Hosokawa Micron Corporation). Thus, cyan toner particles 1 were obtained, which had a weight average particle diameter of 6.4 μm, contained particles each having a particle diameter of 4.0 μm or less at an existence ratio of 25.8 number %, and contained particles each having a particle diameter of 10.0 μm or more at an existence ratio of 2.5 vol %.

Further, the following materials were placed in a Henschel mixer (trade name: FM-75 type, manufactured by NIPPON COKE & ENGINEERING CO., LTD.) and mixed at a circumferential velocity of rotary vanes of 35.0 (m/s) for a mixing time of 3 minutes. Thus, a cyan toner 1 was obtained by causing silica particles and titanium oxide particles to adhere to the surfaces of the cyan toner particles 1.

Cyan toner particles 1: 100 parts by mass

Silica particles (obtained by subjecting silica particles formed by a sol-gel method to surface treatment with 1.5 mass % of hexamethyldisilazane and adjusting the particle size distribution of the silica particles to a desired one by classification): 3.5 parts by mass Titanium oxide particles (obtained by subjecting metatitanic acid having anatase crystallinity to surface treatment with an octylsilane compound): 0.5 part by mass In addition, yellow toner particles 1 and magenta toner particles 1 were obtained in the same manner as in the cyan toner particles 1 except that instead of 4.5 parts by mass of C.I. Pigment Blue 15:3, 7.0 parts by mass of C.I. Pigment Yellow 74 and 6.3 parts by mass of C.I. Pigment Red 122 were used, respectively.

Further, a yellow toner 1 and a magenta toner 1 were each obtained in the same manner as in the cyan toner 1.

Table 3 shows the formulations and physical property values of the resultant toners.

TABLE 3

| | Toner particles | | | | External additive | | Toner particle diameter | | |
|---|---|---|---|---|---|---|---|---|---|
| | Binder resin (100 parts by mass) | Colorant | Release agent | Additive | Silica | Titania | Weight average particle diameter (μm) | Existence ratio of particles each having a particle diameter of 4.0 μm or less (%) | Existence ratio of particles each having a particle diameter of 10.0 μm or more (%) |
| Cyan toner | Polyester resin Tg: 58° C. Acid value: 15 mgKOH/g Hydroxy value: 15 mgKOH/g Molecular weight: Mp 5,800 Mn 3,500 Mw 95,000 | C.I. Pigment Blue 15:3 (4.5 parts by mass) | 6.0 parts by mass of normal paraffin wax Melting point: 78° C. | 0.5 part by mass of aluminum 3,5-di-t-butyl salicylate compound | 3.5 parts by mass | 0.5 part by mass | 6.4 | 25.8 | 2.5 |
| Yellow toner | | C.I. Pigment Yellow 74 (7.0 parts by mass) | | | | | 6.3 | 26.2 | 2.4 |
| Magenta toner | | C.I. Pigment Red 122 (6.3 parts by mass) | | | | | 6.3 | 25. 9 | 2.5 |

Example 1

10 Parts by mass each of the color toners 1 were added to 90 parts by mass of the magnetic carrier 1, and the mixtures were each shaken with a shaking apparatus (YS-8D type, manufactured by YAYOI CO., LTD.) to prepare 300 g each of two-component developers. The amplitude conditions of the shaking apparatus were set to 200 rpm and 2 minutes.

On the other hand, 90 parts by mass each of the color toners 1 were added to 10 parts by mass of the magnetic carrier 1, and the mixtures were each subjected to mixing with a V-shaped mixer for 5 minutes in an environment of normal temperature and normal humidity having a temperature of 23° C. and a humidity of 50% RH (hereinafter referred to as "N/N"), to provide replenishing developers.

Evaluations were performed as described below by using the two-component developers and the replenishing developers.

As an image forming apparatus, a remodeled version of a color copying machine manufactured by Canon Inc. (trade name: image RUNNER ADVANCE C9075 PRO) was used.

The two-component developers were put in the developing devices for the respective colors, and replenishing developer containers containing the replenishing developers for the respective colors were set. Then, an image was formed and subjected to various evaluations.

The copying machine was left to stand in the following environment: the copying machine was left to stand in an environment of a temperature of 23° C. and a humidity of 5% RH (hereinafter referred to as "N/L") for 72 hours or more to be sufficiently moisture-conditioned, and the environment was changed therefrom to an environment of a temperature of 30° C. and a humidity of 80% RH (hereinafter referred to as "H/H") in 3 hours. The environmental state in this case was referred to as "H/Ha". In addition, the copying machine was left to stand in the H/H environment for 72 hours after the H/Ha environmental state to be moisture-conditioned, and the environmental state in this case was referred to as "H/Hb".

Similarly, the copying machine was left to stand in the H/H environment for 72 hours or more to be sufficiently moisture-conditioned, and the environment was changed therefrom to the N/L environment in 3 hours. The environmental state in this case was referred to as "N/La". In addition, the copying machine was left to stand in the N/L environment for 72 hours after the N/La environmental state to be moisture-conditioned, and the environmental state in this case was referred to as "N/Lb".

The kind of the output image and the number of sheets to be output were changed in accordance with evaluation items.

Conditions:

Paper: Laser beam printer paper (trade name: CS-814 (81.4 g/m$^2$, manufactured by Canon Marketing Japan Inc.)

Image forming rate: The copying machine was remodeled so that 80 sheets of A4-size paper were able to be output per minute in full color.

Developing conditions: The copying machine was remodeled so that developing contrast was able to be adjusted to an arbitrary value and automatic correction by the machine did not operate.

The copying machine was remodeled so that the peak-to-peak voltage (Vpp) of the alternating electric field was able to be changed from 0.7 kV to 1.8 kV by 0.1 kV at a frequency of 2.0 kHz.

The copying machine was remodeled so that an image was able to be output with the respective colors alone.

The evaluation items are described below.

(1) Gradation Changes in Respective Environmental States

An image including patterns each having a density set to the following value was output on 10 sheets in the N/N environment. In addition, the same image was output on 10 sheets in each of the above-mentioned environments. Average values for the patterns in the 10 sheets of images output in the respective environments were calculated with Color reflection densitometer X-Rite 404A.

Pattern 1: 0.10 or more and 0.15 or less

Pattern 2: 0.25 or more and 0.30 or less

Pattern 3: 0.45 or more and 0.50 or less
Pattern 4: 0.65 or more and 0.70 or less
Pattern 5: 0.85 or more and 0.90 or less
Pattern 6: 1.05 or more and 1.10 or less
Pattern 7: 1.25 or more and 1.30 or less
Pattern 8: 1.45 or more and 1.50 or less The comparison in pattern density between the N/N environment and the N/Lb environmental state was represented as evaluation S, the comparison in pattern density between the N/La environmental state and the N/Lb environmental state was represented as evaluation T, the comparison in pattern density between the N/N environment and the H/Hb environmental state was represented as evaluation U, and the comparison in pattern density between the H/Ha environmental state and the H/Hb environmental state was represented as evaluation V.

The evaluation S and the evaluation U are based on the following criteria.

A: All the pattern images satisfy the above-mentioned density range.

B: One pattern image deviates from the above-mentioned density range.

C: Two pattern images deviate from the above-mentioned density range.

D: Three pattern images deviate from the above-mentioned density range.

In addition, the evaluation T and the evaluation V are based on the following criteria based on judgment of the number of patterns having a density difference of 0.06 or more between the environmental states.

A: There is no pattern having a density difference of 0.06 or more.

B: The number of patterns having a density difference of 0.06 or more is 1 or more and 2 or less.

C: The number of patterns having a density difference of 0.06 or more is 3 or more and 4 or less.

D: The number of patterns having a density difference of 0.06 or more is 5 or more and 6 or less.

(2) Color Tint Change of Mixed Color

Red, which was a mixed color between yellow and magenta, was evaluated for a color tint change.

A solid red image was output on 10 sheets in the N/La environmental state after the developing contrast was adjusted so that the reflection densities of solid images of the respective colors alone on the paper were each 1.50. After that, the same solid red image was output on 10 sheets in the N/Lb environmental state. A confirmation evaluation for the degree of a color tint change between the N/La environmental state and the N/Lb environmental state was represented as evaluation W.

Similarly, a solid red image was output on 10 sheets in the H/Ha environmental state after the developing contrast was adjusted so that the reflection densities of solid images of the respective colors alone on the paper were each 1.50. After that, the same solid red image was output on 10 sheets in the H/Hb environmental state. A confirmation evaluation for the degree of a color tint change between the H/Ha environmental state and the H/Hb environmental state was represented as evaluation X.

<Measurement Method for Color Tint Change>

The color tint change is determined by measuring a* and b* with SpectroScan Transmission (manufactured by GretagMacbeth). An example of specific measurement conditions is described below.

(Measurement Conditions)

Light source for observation: D50
Field of view: 2°
Concentration: DIN NB
White reference: Pap
Filter: none In general, a* and b* are values to be used in a L*a*b* color coordinate system as means useful in representing a color by digitizing the color. a* and b* both represent a hue. The hue measures a color tone such as red, yellow, green, blue, and violet. Each of a* and b* represents a color direction, and a* represents a red-green direction and b* represents a yellow-blue direction. In the present invention, a difference in color tint change (ΔC) was defined by the following equation (4).

$$\Delta C=\{(a^* \text{ of image in } N/La,H/Ha-a^* \text{ of image in } N/Lb,H/Hb)^2+(b^* \text{ of image in } N/La,H/Ha-b^* \text{ of image in } N/Lb,H/Hb)_2\}^{1/2} \quad (4)$$

The measurement was performed on arbitrary 5 points in the image, and the average of the measured values was determined. The evaluation method was as follows: the solid images output in the respective environments were each measured for a* and b*, and the ΔC was determined by the above-mentioned equation.

A: $0 \leq \Delta C < 1.50$
B: $1.50 \leq \Delta C < 2.50$
C: $2.50 \leq \Delta C < 3.50$
D: $3.50 \leq \Delta C < 5.00$ (3) Fogging Immediately after the H/Ha environmental state, an A4-size solid image having an image area ratio of 40% was continuously output on 1,000 sheets. After that, an A4-size entire solid white image was output on 10 sheets, and the whiteness of white background areas was measured with a reflectometer (manufactured by Tokyo Denshoku Co., Ltd.). A fog density (%) was calculated from the difference between the whiteness and the whiteness of a transfer sheet, and the highest fog density in the 10 sheets was presented as evaluation Y. The evaluation Y was based on the following criteria.

A: less than 0.4%
B: 0.4% or more and less than 0.8%
C: 0.8% or more and less than 1.2%
D: 1.2% or more and less than 1.6%

(4) Scattering Property in Image

Figure 3:
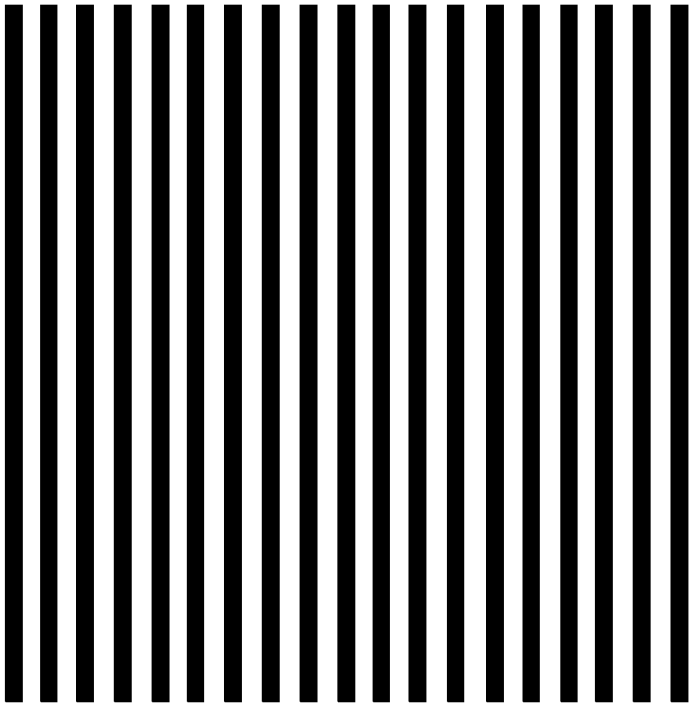
FIG. 3 is an image for scattering evaluation.

Immediately after the N/La environmental state, an image illustrated in FIG. 3 (the number of lines: 19, line width: 100 μm, line interval: 300 μm, line length: 1.0 cm) was output as an unfixed image on 10 sheets, and then left to stand in an oven at 100° C. for 3 minutes to be fixed.

The line images were observed with a magnifier, and the number of toner adhesion spots scattering around the line images was counted. The largest number in the 10 sheets was presented as Evaluation Z. The evaluation Z was based on the following criteria.

A: The number of scattering spots is 19 or less
B: The number of scattering spots is 20 or more and 29 or less
C: The number of scattering spots is 30 or more and 39 or less
D: The number of scattering spots is 40 or more and 49 or less (5) Total Judgment The evaluation ranks in the above-mentioned evaluations S to Z were quantified (A=5, B=4, C=3, D=2, and E=0), and the total value was judged based on the following criteria.

A: 37 or more and 40 or less
B: 32 or more and 36 or less
C: 28 or more and 31 or less D: 20 or more and 27 or less E: 19 or less In Example 1, an extremely good result was obtained in each of the evaluations. The evaluation results are shown in Tables 4 to 6.

Examples 2 and 3

Each of the magnetic carriers 2 and 3 was used to prepare two-component developers and replenishing developers in the same manner as in Example 1 at the same ratio between the toner and the magnetic carrier as in Example 1. The evaluations were performed in the same manner as in Example 1 except that the obtained developers were used.

While Examples 2 and 3 each differ from Example 1 in the compound allowed to react with the hydroxy group on the surface of the magnetic carrier core, the adsorbed moisture amount was low and extremely good results were obtained in each of the examples. The evaluation results are shown in Tables 4 to 6.

Example 4

The magnetic carrier 4 was used to prepare two-component developers and replenishing developers in the same manner as in Example 1 at the same ratio between the toner and the magnetic carrier as in Example 1. The evaluations were performed in the same manner as in Example 1 except that the obtained developers were used.

In Example 4, the treatment was performed without allowing stearic acid to react with the hydroxy group on the surface of the magnetic carrier core, as compared to Example 1. As a result, the adsorbed moisture amount of the magnetic carrier was slightly high. As a result, chargeability stability to an environmental change was slightly reduced.

As a result, the color tint change and the scattering property were slightly affected by the environmental change from the N/L environment to the H/H environment, but there was no problem. In addition, except for the foregoing, extremely good results were obtained. The evaluation results are shown in Tables 4 to 6.

Examples 5 and 6

Each of the magnetic carriers 5 and 6 was used to prepare two-component developers and replenishing developers in the same manner as in Example 1 at the same ratio between the toner and the magnetic carrier as in Example 1. The evaluations were performed in the same manner as in Example 1 except that the obtained developers were used.

Each of Examples 5 and 6 differs from Example 4 in the kind of the compound used for the surface treatment of the magnetic carrier core. The adsorbed moisture amount and the evaluation results did not largely differ from those in Example 4. The color tint change and the scattering property were slightly affected, but there was no problem. In addition, except for the foregoing, extremely good results were obtained. The evaluation results are shown in Tables 4 to 6.

Example 7

The magnetic carrier 7 was used to prepare two-component developers and replenishing developers in the same manner as in Example 1 at the same ratio between the toner and the magnetic carrier as in Example 1. The evaluations were performed in the same manner as in Example 1 except that the obtained developers were used.

As with Example 6, Example 7 differs from Example 4 in the kind of the compound used for the treatment, but the adsorbed moisture amount is higher than that in Example 6. Therefore, color tint stability was slightly lower than that in Example 6, but there was no problem. In addition, except for the foregoing, extremely good results were obtained. The evaluation results are shown in Tables 4 to 6.

Example 8

The magnetic carrier 8 was used to prepare two-component developers and replenishing developers in the same manner as in Example 1 at the same ratio between the toner and the magnetic carrier as in Example 1. The evaluations were performed in the same manner as in Example 1 except that the obtained developers were used.

Example 8 differs from Example 2 in the kind and amount of the compound, and in that the adsorbed moisture amount is even larger. Those differences slightly affected image density stability. The evaluation results are shown in Tables 4 to 6.

Examples 9 to 11

Each of the magnetic carriers 9 to 11 was used to prepare two-component developers and replenishing developers in the same manner as in Example 1 at the same ratio between the toner and the magnetic carrier as in Example 1. The evaluations were performed in the same manner as in Example 1 except that the obtained developers were used.

Each of Examples 9 to 11 uses the porous magnetic particles in which the resin having a hydroxy group is filled in the pores of the particles.

In Example 9, as in Example 1, a low adsorbed moisture amount was obtained by allowing stearic acid to react with the hydroxy group, and extremely good results were obtained in each of the evaluations. The evaluation results are shown in Tables 4 to 6.

In Example 10, the same treatment as in Example 5 was performed except that a different magnetic carrier core was used. The difference in the kind of the magnetic carrier core offered slight differences in the evaluation results of the scattering property and the fogging, but the stability in the density and color tint was at the same level as that in Example 5. In Example 10, except for the color tint change and the fogging, extremely good results were obtained. The evaluation results are shown in Tables 4 to 6.

In Example 11, the same treatment as in Example 8 was performed except that a different magnetic carrier core was used. The difference in the kind of the magnetic carrier core offered slight differences in the evaluation results of the scattering property and the fogging, but the adsorbed moisture amount and the stability in the density and color tint were at the same levels as those in Example 8. The evaluation results are shown in Tables 4 to 6.

Examples 12 and 13

Each of the magnetic carriers 12 and 18 was used to prepare two-component developers and replenishing developers in the same manner as in Example 1 at the same ratio between the toner and the magnetic carrier as in Example 1. The evaluations were performed in the same manner as in Example 1 except that the obtained developers were used.

In Example 12, the adsorbed moisture amount was large owing to the kind and amount of the compound. The increase in adsorbed moisture amount caused differences in density, color tint change and fogging. The evaluation results are shown in Tables 4 to 6.

In addition, in Example 13, the magnetic carrier core was not subjected to the drying step. As a result, the environmental stability was slightly reduced as compared to that in Example 12. The evaluation results are shown in Tables 4 to 6.

Comparative Example 1

The magnetic carrier 13 was used to prepare two-component developers and replenishing developers in the same manner as in Example 1 at the same ratio between the toner and the magnetic carrier as in Example 1. The evaluations were performed in the same manner as in Example 1 except that the obtained developers were used.

In Comparative Example 1, the amount of the compound to be used for the treatment was even lower as compared to that in Example 12. Consequently, also the adsorbed moisture amount was large. Therefore, the chargeability stability to environmental changes lowered. In addition, particularly when the environment was changed from the N/L environment to the H/H environment, the change amounts in density and color tint between the environments were remarkably large, which seemed to be because that the amount of moisture to be desorbed was not compensated for. The evaluation results are shown in Tables 4 to 6.

Comparative Example 2

The magnetic carrier 14 was used to prepare two-component developers and replenishing developers in the same manner as in Example 1 at the same ratio between the toner and the magnetic carrier as in Example 1. The evaluations were performed in the same manner as in Example 1 except that the obtained developers were used.

Comparative Example 2 uses a magnetic carrier core obtained by allowing an aminosilane coupling agent as a treating agent to react with the hydroxy group of the resin. With this, the moisture adsorbability was improved, but owing to the treating agent, when the environment was changed from the H/H environment to the N/L environment, the changes in density and color tint were remarkable as compared to those in Example 1. The evaluation results are shown in Tables 4 to 6.

Comparative Example 3

The magnetic carrier 15 was used to prepare two-component developers and replenishing developers in the same manner as in Example 1 at the same ratio between the toner and the magnetic carrier as in Example 1. The evaluations were performed in the same manner as in Example 1 except that the obtained developers were used.

In Comparative Example 3, the hydroxy group of the magnetic carrier core resin was treated with a short-chain fatty acid. The compound used in Comparative Example 3 did not sufficiently reduce the adsorbed moisture amount, and in particular, the color tint changes through the respective environmental changes were remarkable as compared to those in Example 1. The evaluation results are shown in Tables 4 to 6.

Comparative Example 4

The magnetic carrier 16 was used to prepare two-component developers and replenishing developers in the same manner as in Example 1 at the same ratio between the toner and the magnetic carrier as in Example 1. The evaluations were performed in the same manner as in Example 1 except that the obtained developers were used.

In Comparative Example 4, the treatment was performed without allowing formic acid to react. The compound used in Comparative Example 4 brought a further increase in adsorbed moisture amount as compared to Comparative Example 3, and particularly when the environment was changed from the N/L environment to the H/H environment, the changes in density and color tint were remarkable, and the fogging was caused seriously. The evaluation results are shown in Tables 4 to 6.

Comparative Example 5

The magnetic carrier 17 was used to prepare two-component developers and replenishing developers in the same manner as in Example 1 at the same ratio between the toner and the magnetic carrier as in Example 1. The evaluations were performed in the same manner as in Example 1 except that the obtained developers were used.

In Comparative Example 5, no treatment was performed on the surface of the magnetic carrier core. In Comparative Example 5, the adsorbed moisture amount was large, and Comparative Example 5 was remarkably inferior to Example 1 in various respects through environmental changes, such as the output image density change, the color tint change, the fogging, and the scattering property. The evaluation results are shown in Tables 4 to 6.

TABLE 4

| | | Gradation density change | | | | | | | | | | |
|---|---|---|---|---|---|---|---|---|---|---|---|---|
| | | Evaluation S(N/N—N/Lb) | | | Evaluation T(N/La—N/Lb) Number of patterns having a density difference of 0.06 or more (pattern(s)) | | Evaluation U(N/N—H/Hb) | | | Evaluation V[H/Ha—H/Hb) Number of patterns having a density difference of 0.06 or more (pattern(s)) | | |
| | | *Deviating pattern number | Number of deviating patterns (pattern(s)) | Evaluation | | Evaluation | *Deviating pattern number | Number of deviating patterns (pattern(s)) | Evaluation | | Evaluation | Judgment index |
| Example 1 | Magnetic carrier 1 | — | 0 | A | 0 | A | — | 0 | A | 0 | A | 20 |
| Example 2 | Magnetic carrier 2 | — | 0 | A | 0 | A | — | 0 | A | 0 | A | 20 |

TABLE 4-continued

| | | Gradation density change | | | | | | | | | | |
|---|---|---|---|---|---|---|---|---|---|---|---|---|
| | | Evaluation S(N/N—N/Lb) | | | Evaluation T(N/La—N/Lb) Number of patterns having | | Evaluation U(N/N—H/Hb) | | | Evaluation V[H/Ha—H/Hb) Number of patterns having | | |
| | | *Deviating pattern number | Number of deviating patterns (pattern(s)) | Evaluation | a density difference of 0.06 or more (pattern(s)) | Evaluation | *Deviating pattern number | Number of deviating patterns (pattern(s)) | Evaluation | a density difference of 0.06 or more (pattern(s)) | Evaluation | Judgment index |
| Example 3 | Magnetic carrier 3 | — | 0 | A | 0 | A | — | 0 | A | 0 | A | 20 |
| Example 4 | Magnetic carrier 4 | — | 0 | A | 0 | A | — | 0 | A | 0 | A | 20 |
| Example 5 | Magnetic carrier 5 | — | 0 | A | 0 | A | — | 0 | A | 0 | A | 20 |
| Example 6 | Magnetic carrier 6 | — | 0 | A | 0 | A | — | 0 | A | 0 | A | 20 |
| Example 7 | Magnetic carrier 7 | — | 0 | A | 0 | A | — | 0 | A | 0 | A | 20 |
| Example 8 | Magnetic carrier 8 | — | 0 | A | 1 | B | — | 0 | A | 1 | B | 18 |
| Example 9 | Magnetic carrier 9 | — | 0 | A | 0 | A | — | 0 | A | 0 | A | 20 |
| Example 10 | Magnetic carrier 10 | — | 0 | A | 0 | A | — | 0 | A | 0 | A | 20 |
| Example 11 | Magnetic carrier 11 | — | 0 | A | 1 | B | — | 0 | A | 1 | B | 18 |
| Example 12 | Magnetic carrier 12 | — | 0 | A | 1 | B | — | 0 | A | 2 | B | 18 |
| Example 13 | Magnetic carrier 18 | 4 | 1 | B | 1 | B | 1 | 1 | B | 2 | B | 16 |
| Comparative Example 1 | Magnetic carrier 13 | 3 | 1 | B | 2 | B | 3, 5 | 2 | C | 5 | D | 13 |
| Comparative Example 2 | Magnetic carrier 14 | 2, 5, 7 | 3 | D | 5 | D | 2 | 1 | B | 2 | B | 12 |
| Comparative Example 3 | Magnetic carrier 15 | 5 | 1 | B | 3 | C | 3, 4 | 2 | C | 3 | C | 13 |
| Comparative Example 4 | Magnetic carrier 16 | 3, 6 | 2 | C | 4 | C | 3, 4 | 2 | C | 4 | C | 12 |
| Comparative Example 5 | Magnetic carrier 17 | 2, 7 | 2 | C | 4 | C | 2, 5 | 2 | C | 6 | D | 11 |

*A pattern number indicates the number of a pattern with a deviating gradation.

TABLE 5

| | | Red hue (a*b*) | | | | | | | | Evaluation W | | Evaluation X | | |
|---|---|---|---|---|---|---|---|---|---|---|---|---|---|---|
| | | N/La | | N/Lb | | H/Ha | | H/Hb | | N/La—N/Lb | | H/Ha—H/Hb | | Judgment |
| | | a* | b* | a* | b* | a* | b* | a* | b* | ΔC | Evaluation | ΔC | Evaluation | index |
| Example 1 | Magnetic carrier 1 | 44.98 | 37.46 | 44.45 | 36.61 | 44.87 | 37.42 | 45.49 | 38.15 | 1.00 | A | 0.96 | A | 10 |
| Example 2 | Magnetic carrier 2 | 44.89 | 37.38 | 43.92 | 36.74 | 44.61 | 37.51 | 45.75 | 38.15 | 1.16 | A | 1.31 | A | 10 |
| Example 3 | Magnetic carrier 3 | 44.76 | 37.58 | 44.12 | 36.87 | 44.44 | 37.61 | 45.37 | 37.98 | 0.96 | A | 1.00 | A | 10 |
| Example 4 | Magnetic carrier 4 | 44.67 | 37.57 | 44.06 | 36.41 | 44.78 | 37.63 | 46. 03 | 38.52 | 1.31 | A | 1.53 | B | 9 |
| Example 5 | Magnetic carrier 5 | 44.85 | 37.29 | 43.59 | 36.71 | 44.81 | 37.41 | 46.19 | 38.15 | 1.39 | A | 1.57 | B | 9 |
| Example 6 | Magnetic carrier 6 | 44.58 | 37.88 | 43.48 | 36.89 | 44.23 | 37.89 | 46.29 | 38.03 | 1.48 | A | 2.06 | B | 9 |
| Example 7 | Magnetic carrier 7 | 44.90 | 37.15 | 43.47 | 36.42 | 44.85 | 37.23 | 46.55 | 39.10 | 1.61 | B | 2.53 | C | 7 |
| Example 8 | Magnetic carrier 8 | 44.79 | 37.29 | 43.06 | 36.11 | 44.77 | 37.41 | 46.38 | 38.79 | 2.09 | B | 2.12 | B | 8 |
| Example 9 | Magnetic carrier 9 | 44.21 | 37.55 | 44.03 | 36.39 | 44.36 | 37.53 | 44.89 | 38.22 | 1.17 | A | 0.87 | A | 10 |
| Example 10 | Magnetic carrier 10 | 45.01 | 37.49 | 44.15 | 36.35 | 44.97 | 37.42 | 45.20 | 38.98 | 1.43 | A | 1.58 | B | 9 |

TABLE 5-continued

| | | Red hue (a*b*) | | | | | | | | Evaluation W | | Evaluation X | | |
|---|---|---|---|---|---|---|---|---|---|---|---|---|---|---|
| | | N/La | | N/Lb | | H/Ha | | H/Hb | | N/La—N/Lb | | H/Ha—H/Hb | | Judgment |
| | | a* | b* | a* | b* | a* | b* | a* | b* | ΔC | Evaluation | ΔC | Evaluation | index |
| Example 11 | Magnetic carrier 11 | 44.83 | 37.64 | 42.82 | 35.79 | 44.84 | 37.59 | 46.73 | 39.15 | 2.73 | C | 2.45 | B | 7 |
| Example 12 | Magnetic carrier 12 | 44.54 | 37.10 | 42.92 | 35.55 | 44.61 | 37.20 | 47.39 | 38.75 | 2.24 | B | 3.18 | C | 7 |
| Example 13 | Magnetic carrier 18 | 44.61 | 37.18 | 42.91 | 35.47 | 44.58 | 37.20 | 47.52 | 39.04 | 2.41 | B | 3.47 | C | 7 |
| Comparative Example 1 | Magnetic carrier 13 | 44.75 | 37.54 | 42.20 | 35.68 | 44.72 | 37.39 | 48.00 | 39.16 | 3.16 | C | 3.73 | D | 5 |
| Comparative Example 2 | Magnetic carrier 14 | 44.96 | 37.15 | 41.95 | 33.38 | 44.99 | 37.22 | 46.53 | 38.55 | 4.82 | D | 2.03 | B | 6 |
| Comparative Example 3 | Magnetic carrier 15 | 44.67 | 37.22 | 42.63 | 34.19 | 44.71 | 37.36 | 48.22 | 38.76 | 3.65 | D | 3.78 | D | 4 |
| Comparative Example 4 | Magnetic carrier 16 | 44.58 | 37.19 | 41.47 | 34.25 | 44.54 | 37.35 | 48.59 | 38.86 | 4.28 | D | 4.32 | D | 4 |
| Comparative Example 5 | Magnetic carrier 17 | 44.93 | 37.35 | 41.58 | 34.29 | 44.87 | 37.48 | 49.23 | 39.05 | 4.54 | D | 4.63 | D | 4 |

TABLE 6

| | | Evaluation Y Fogging | | Evaluation Z Scattering | | Total Evaluation | | |
|---|---|---|---|---|---|---|---|---|
| | | Density (%) | Evaluation | Number (pieces) | Evaluation | Evaluation S | Evaluation T | Evaluation U |
| Example 1 | Magnetic carrier 1 | 0.2 | A | 13 | A | 5 | 5 | 5 |
| Example 2 | Magnetic carrier 2 | 0.3 | A | 15 | A | 5 | 5 | 5 |
| Example 3 | Magnetic carrier 3 | 0.2 | A | 9 | A | 5 | 5 | 5 |
| Example 4 | Magnetic carrier 4 | 0.3 | A | 21 | B | 5 | 5 | 5 |
| Example 5 | Magnetic carrier 5 | 0.3 | A | 23 | B | 5 | 5 | 5 |
| Example 6 | Magnetic carrier 6 | 0.3 | A | 24 | B | 5 | 5 | 5 |
| Example 7 | Magnetic carrier 7 | 0.3 | A | 26 | B | 5 | 5 | 5 |
| Example 8 | Magnetic carrier 8 | 0.4 | B | 30 | C | 5 | 4 | 5 |
| Example 9 | Magnetic carrier 9 | 0.3 | A | 8 | A | 5 | 5 | 5 |
| Example 10 | Magnetic carrier 10 | 0.5 | B | 16 | A | 5 | 5 | 5 |
| Example 11 | Magnetic carrier 11 | 0.8 | C | 26 | B | 5 | 4 | 5 |
| Example 12 | Magnetic carrier 12 | 0.8 | C | 33 | C | 5 | 4 | 5 |
| Example 13 | Magnetic carrier 18 | 0.9 | C | 37 | C | 4 | 4 | 4 |
| Comparative Example 1 | Magnetic carrier 13 | 0.3 | A | 26 | B | 4 | 4 | 3 |
| Comparative Example 2 | Magnetic carrier 14 | 0.6 | B | 29 | B | 2 | 2 | 4 |
| Comparative Example 3 | Magnetic carrier 15 | 0.7 | B | 34 | C | 4 | 3 | 3 |
| Comparative Example 4 | Magnetic carrier 16 | 1.0 | C | 38 | C | 3 | 3 | 3 |
| Comparative Example 5 | Magnetic carrier 17 | 1.3 | D | 45 | D | 3 | 3 | 3 |

| | | Total Evaluation | | | | | | |
|---|---|---|---|---|---|---|---|---|
| | | Evaluation V | Evaluation W | Evaluation X | Evaluation Y | Evaluation Z | Judgment index | Evaluation |
| Example 1 | Magnetic carrier 1 | 5 | 5 | 5 | 5 | 5 | 40 | A |
| Example 2 | Magnetic carrier 2 | 5 | 5 | 5 | 5 | 5 | 40 | A |

TABLE 6-continued

| | | | | | | | | |
|---|---|---|---|---|---|---|---|---|
| Example 3 | Magnetic carrier 3 | 5 | 5 | 5 | 5 | 5 | 40 | A |
| Example 4 | Magnetic carrier 4 | 5 | 5 | 4 | 5 | 4 | 38 | A |
| Example 5 | Magnetic carrier 5 | 5 | 5 | 4 | 5 | 4 | 38 | A |
| Example 6 | Magnetic carrier 6 | 5 | 5 | 4 | 5 | 4 | 38 | A |
| Example 7 | Magnetic carrier 7 | 5 | 4 | 3 | 5 | 4 | 36 | B |
| Example 8 | Magnetic carrier 8 | 4 | 4 | 4 | 4 | 3 | 33 | B |
| Example 9 | Magnetic carrier 9 | 5 | 5 | 5 | 5 | 5 | 40 | A |
| Example 10 | Magnetic carrier 10 | 5 | 5 | 4 | 4 | 5 | 38 | A |
| Example 11 | Magnetic carrier 11 | 4 | 3 | 4 | 3 | 4 | 32 | B |
| Example 12 | Magnetic carrier 12 | 4 | 4 | 3 | 3 | 3 | 31 | C |
| Example 13 | Magnetic carrier 18 | 4 | 4 | 3 | 3 | 3 | 29 | C |
| Comparative Example 1 | Magnetic carrier 13 | 2 | 3 | 2 | 5 | 4 | 27 | D |
| Comparative Example 2 | Magnetic carrier 14 | 4 | 2 | 4 | 4 | 4 | 26 | D |
| Comparative Example 3 | Magnetic carrier 15 | 3 | 2 | 2 | 4 | 3 | 24 | D |
| Comparative Example 4 | Magnetic carrier 16 | 3 | 2 | 2 | 3 | 3 | 22 | D |
| Comparative Example 5 | Magnetic carrier 17 | 2 | 2 | 2 | 2 | 2 | 19 | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-036232 filed Feb. 27, 2014 and Japanese Patent Application No. 2015-032148 filed Feb. 20, 2015 which are hereby incorporated by reference herein in their entirety.

What is claimed is:

1. A magnetic carrier, comprising magnetic carrier particles each comprising a magnetic carrier core, wherein the magnetic carrier core is obtained by intermediate treatment of a magnetic material-dispersed resin particle including a magnetic material and a resin having a hydroxy group, with a compound represented by the following formula (1):

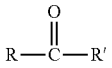

(1)

in which R represents a hydrocarbon group having 8 or more carbon atoms, and R' represents —OH, —Cl, or —$OR^{10}$ and $R^{10}$ represents an organic group having 1 or more carbon atoms, the magnetic carrier particles each further comprises a resin coating layer formed on a surface of the magnetic carrier core, and the magnetic carrier has an adsorbed moisture amount of 0.40 mass % or less when the magnetic carrier is left to stand in an environment of a temperature of 30° C. and a humidity of 80% RH for 72 hours.

2. A magnetic carrier according to claim 1, wherein the magnetic carrier core comprises a magnetic carrier core in which the magnetic material is dispersed in the resin.

3. A magnetic carrier according to claim 2, wherein the magnetic material comprises magnetic iron oxide particles.

4. A magnetic carrier according to claim 1, wherein the magnetic material comprises porous magnetic particles each having pores; and the magnetic carrier core comprises a magnetic carrier core in which the resin is filled into the pores of the porous magnetic particles.

5. A magnetic carrier according to claim 4, wherein the porous magnetic particles each comprise ferrite.

6. A magnetic carrier according to claim 1, wherein a content of the compound represented by the formula (1) in the magnetic carrier core is 0.3 part by mass or more and 4.0 parts by mass or less with respect to 100 parts by mass of the magnetic carrier core.

7. A magnetic carrier according to claim 1, wherein part of the hydroxy group of the resin is esterified with part of the compound represented by the formula (1).

8. A magnetic carrier according to claim 1, wherein the compound represented by the formula (1) comprises at least one compound selected from the group consisting of:

a fatty acid having 9 or more carbon atoms without a hydroxy group;

an ester compound of a fatty acid having 9 or more carbon atoms without a hydroxy group;

an anhydride of a fatty acid having 9 or more carbon atoms without a hydroxy group; and a chloride of a fatty acid having 9 or more carbon atoms without a hydroxy group.

9. A magnetic carrier according to claim 8, wherein the magnetic carrier comprises said fatty acid having 9 or more carbon atoms, which is selected from the group consisting of nonanoic acid, decanoic acid, lauric acid, myristic acid, stearic acid, behenic acid, octacosanoic acid, tetradecanoic acid, and triacontanoic acid.

10. A magnetic carrier according to claim 8, wherein the compound represented by the formula (1) comprises stearyl stearate or behenyl behenate.

11. A two-component developer, comprising the magnetic carrier of claim 1; and a toner.

* * * * *